US010245594B2

(12) United States Patent
Takeuchi

(10) Patent No.: US 10,245,594 B2
(45) Date of Patent: Apr. 2, 2019

(54) OIL REMOVAL APPARATUS

(71) Applicant: TOYOTA JIDOSHA KABUSHIKI KAISHA, Toyota-shi, Aichi (JP)

(72) Inventor: Naoki Takeuchi, Susono (JP)

(73) Assignee: TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 201 days.

(21) Appl. No.: 15/302,195

(22) PCT Filed: Apr. 15, 2015

(86) PCT No.: PCT/JP2015/002072
§ 371 (c)(1),
(2) Date: Oct. 6, 2016

(87) PCT Pub. No.: WO2015/159539
PCT Pub. Date: Oct. 22, 2015

(65) Prior Publication Data

US 2017/0021365 A1 Jan. 26, 2017

(30) Foreign Application Priority Data

Apr. 15, 2014 (JP) ..... 2014-084034

(51) Int. Cl.
*B03C 3/68* (2006.01)
*F01M 13/04* (2006.01)
(Continued)

(52) U.S. Cl.
CPC ..... *B03C 3/68* (2013.01); *B03C 3/06* (2013.01); *B03C 3/08* (2013.01); *B03C 3/366* (2013.01);
(Continued)

(58) Field of Classification Search
CPC combination set(s) only.
See application file for complete search history.

(56) References Cited

U.S. PATENT DOCUMENTS 4,519,357 A * 5/1985 McAllister ..... C01B 13/11 123/537
4,601,799 A * 7/1986 Froberger ..... B01D 35/06 204/562
(Continued)

FOREIGN PATENT DOCUMENTS

CN 102974461 A 3/2013
EP 1990097 A2 11/2008
(Continued)

OTHER PUBLICATIONS

Norikazu Namiki et al. "Characteristics of Particles Generated from Conveyors and Development of a Particle Collection Device for Clean Elevators", Japan Association of Aerosol Science and Technology,1999, pp. 338-347, vol. 14, No. 4.

*Primary Examiner* — Duane Smith
*Assistant Examiner* — Sonji Turner
(74) *Attorney, Agent, or Firm* — Sughrue Mion, PLLC

(57) ABSTRACT

An object of the present invention is to suppress a blockage caused by oil particles in an upstream side of a filter in an oil removal apparatus that collects oil particles in a filter disposed between an anode and a cathode. While an internal combustion engine is operative, application of a voltage to a bipolar electrode is controlled such that a voltage application period, in which the voltage is applied to the bipolar electrode, and a voltage application stoppage period, in which application of the voltage to the bipolar electrode is stopped, are repeated alternately at predetermined periodic intervals.

6 Claims, 14 Drawing Sheets

(51) Int. Cl.
*B03C 3/08* (2006.01)
*B03C 3/06* (2006.01)
*B03C 3/36* (2006.01)

(52) U.S. Cl.
CPC ..... *F01M 13/04* (2013.01); *B03C 2201/30* (2013.01); *B03C 2201/32* (2013.01); *F01M 2013/0438* (2013.01); *F01M 2013/0466* (2013.01)

(56) References Cited

U.S. PATENT DOCUMENTS 4,627,406 A * 12/1986 Namiki ..... F01M 13/04 123/572
4,941,962 A * 7/1990 Inoue ..... B01D 53/323 204/639
5,041,145 A * 8/1991 Kakinuma ..... B03C 3/38 55/DIG. 30
5,487,874 A * 1/1996 Gibboney, Jr. ..... A61L 2/14 422/186.03
5,571,399 A * 11/1996 Allen ..... B01D 35/06 204/665
5,692,481 A * 12/1997 Miller ..... B01D 53/90 123/539
6,058,698 A * 5/2000 Coral ..... B03C 3/38 55/DIG. 30
6,463,917 B1 * 10/2002 Silver ..... F02M 27/04 123/536
6,805,732 B1 * 10/2004 Billiotte ..... A61L 9/22 264/129
6,990,965 B2 * 1/2006 Varasundharosoth ..... B01D 35/06 204/665
7,081,152 B2 * 7/2006 Altman ..... B03C 3/68 323/903
7,258,723 B2 * 8/2007 Crawley ..... B03C 3/68 55/282.3
7,258,729 B1 * 8/2007 Barsimanto ..... B03C 3/09 96/226
7,815,720 B2 * 10/2010 McKinney ..... B03C 3/09 96/63
7,858,054 B2 * 12/2010 Manalo ..... F02M 25/06 123/536
8,564,924 B1 * 10/2013 Waddell ..... H01T 23/00 361/231
8,789,517 B2 * 7/2014 Narita ..... F01M 13/022 123/572
2003/0037676 A1 * 2/2003 Dunshee ..... A61L 2/14 422/186.03
2004/0226449 A1 11/2004 Heckel et al.
2005/0224022 A1 10/2005 Heckel et al.
2005/0224023 A1 10/2005 Heckel et al.
2005/0237693 A1 10/2005 Heckel et al.
2008/0056934 A1 * 3/2008 Tsui ..... A61L 9/22 422/2
2011/0283886 A1 * 11/2011 Ladha ..... B01D 46/0068 95/278

FOREIGN PATENT DOCUMENTS

FR 2363373 A1 3/1978
JP 11179234 A 7/1999
JP 2005103357 A * 4/2005
JP 2005103357 A 4/2005
JP 2005-334876 A 12/2005
JP 2009008096 A * 1/2009 ..... B03C 3/06

* cited by examiner

[Fig. 1]
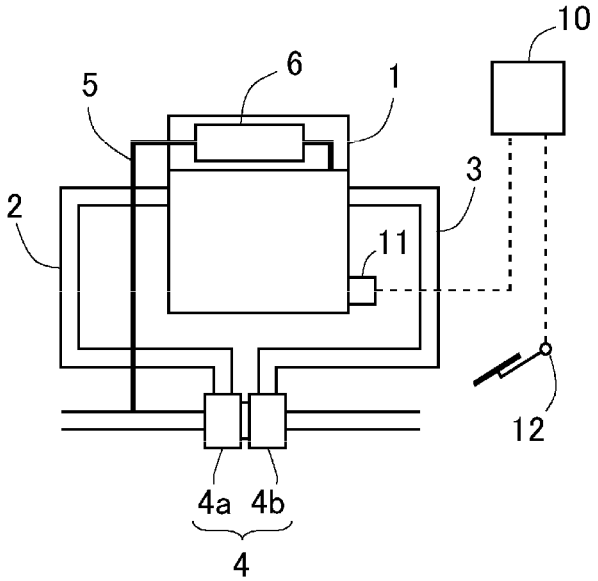
[Fig. 2]
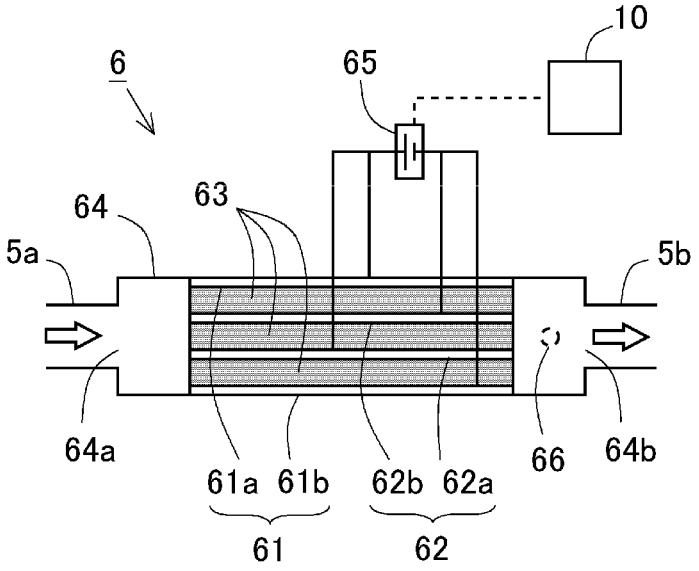

[Fig. 3]
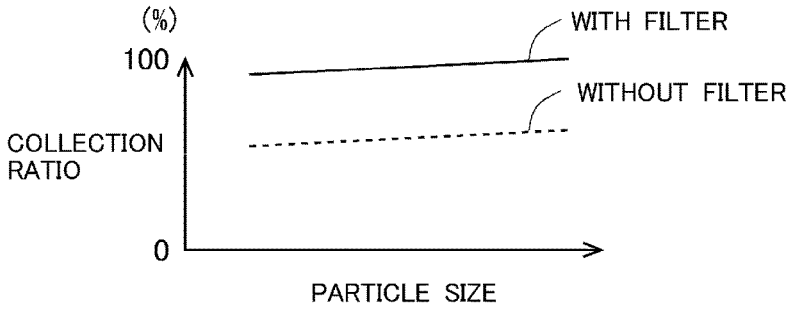
[Fig. 4]
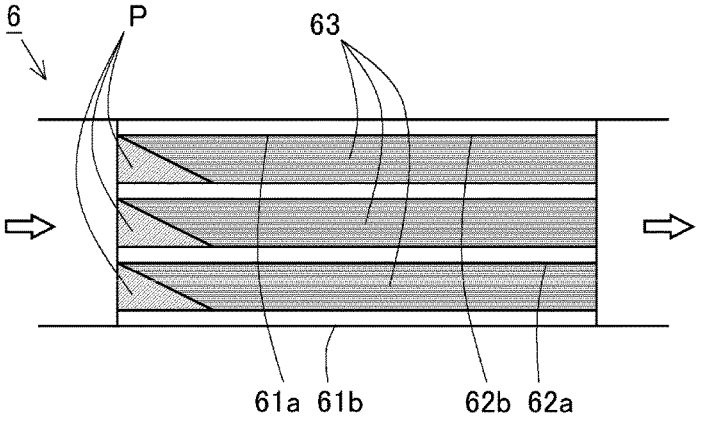
[Fig. 5]
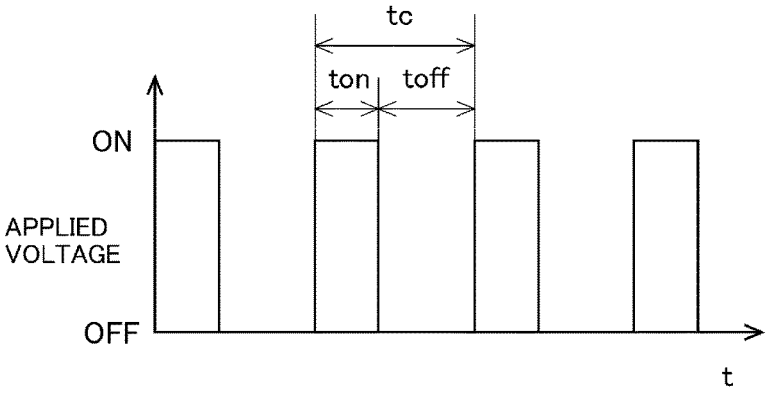

[Fig. 6]
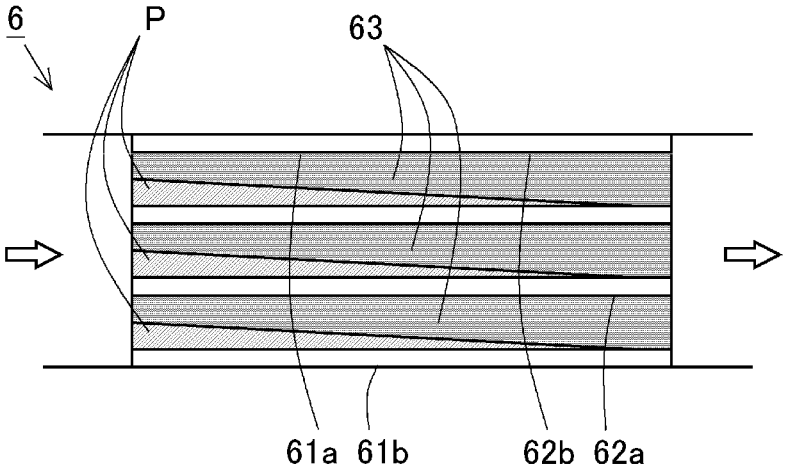
[Fig. 7]
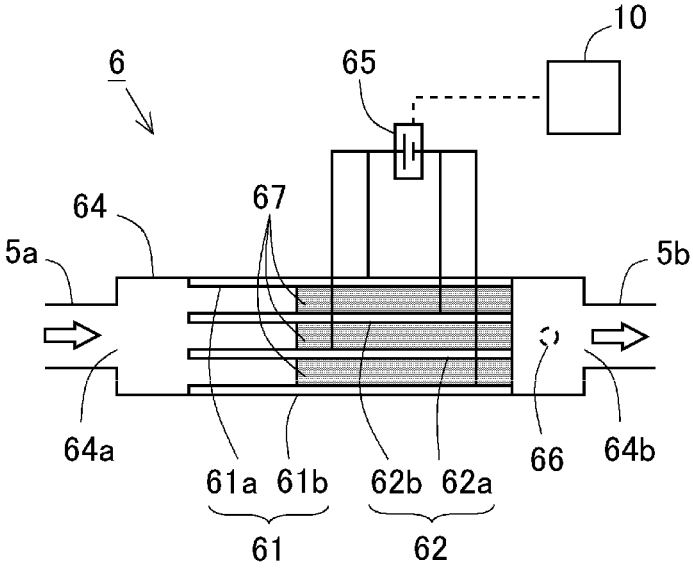

[Fig. 8]
(a)
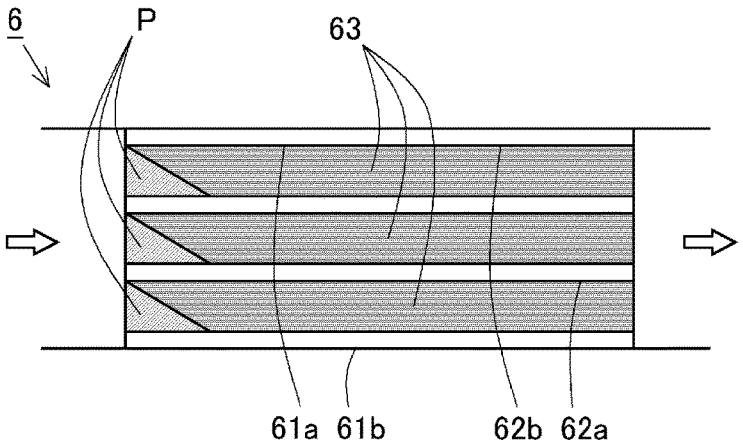
(b)
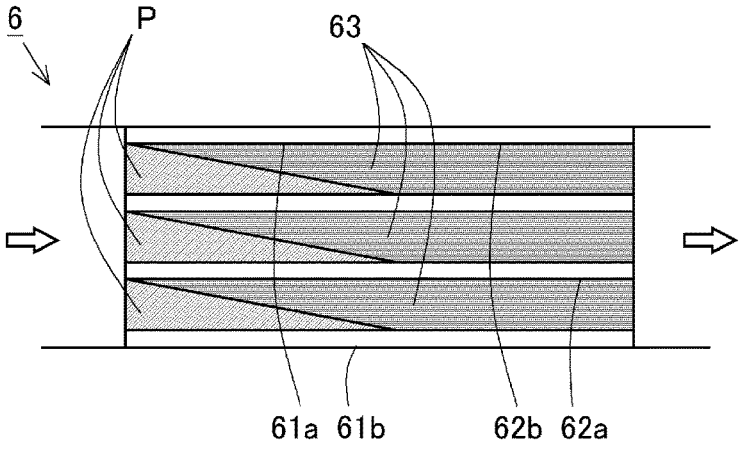

[Fig. 9]
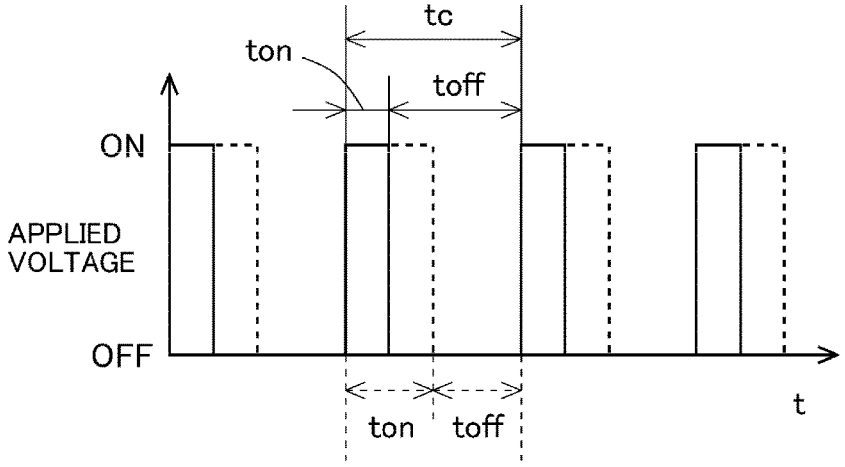

[Fig. 10]
(a)
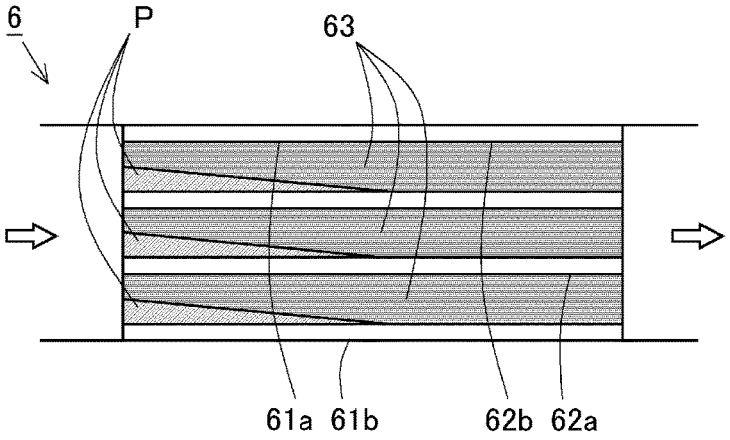
(b)
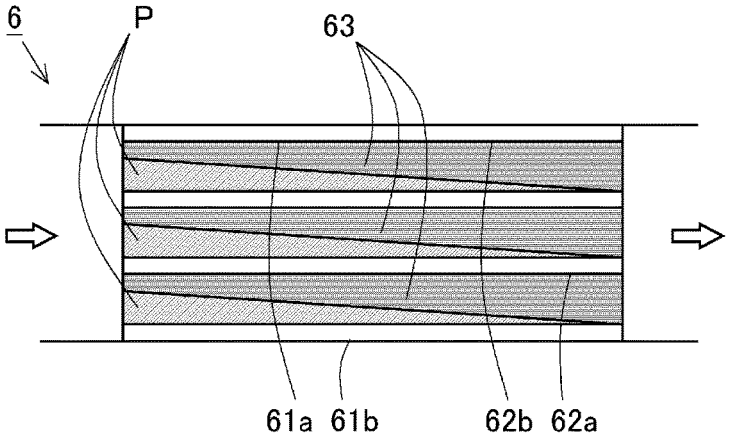

[Fig. 11]
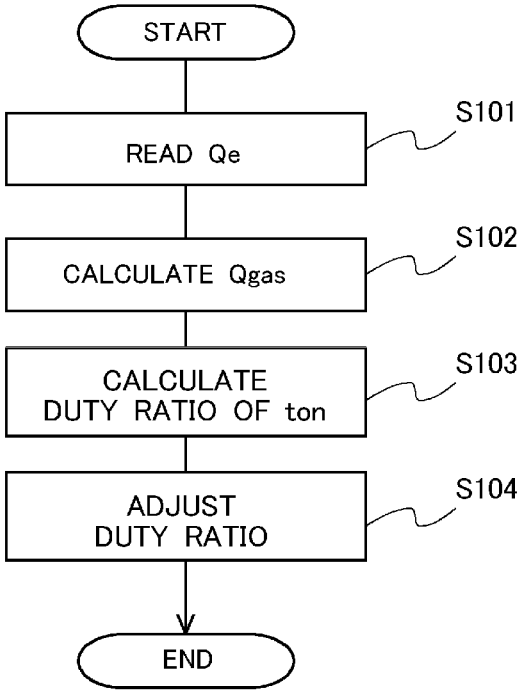
[Fig. 12]
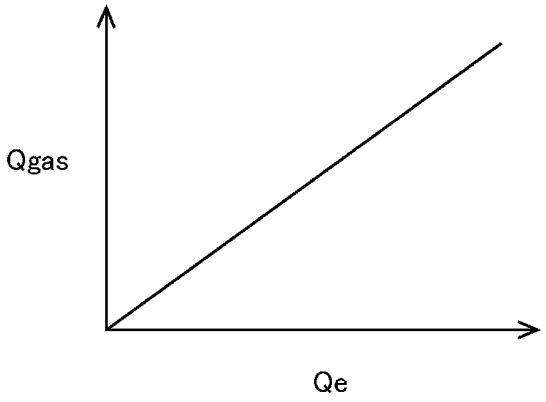

[Fig. 13]
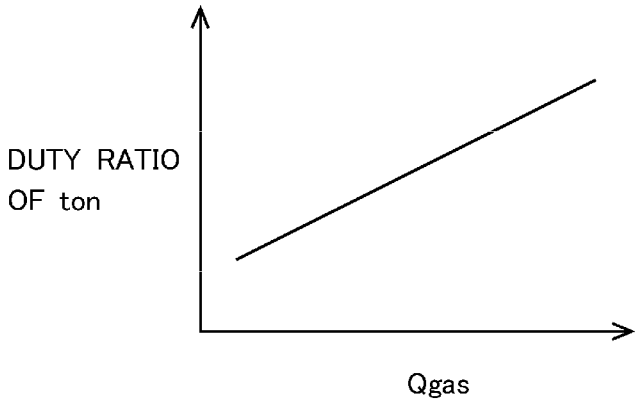
[Fig. 14]
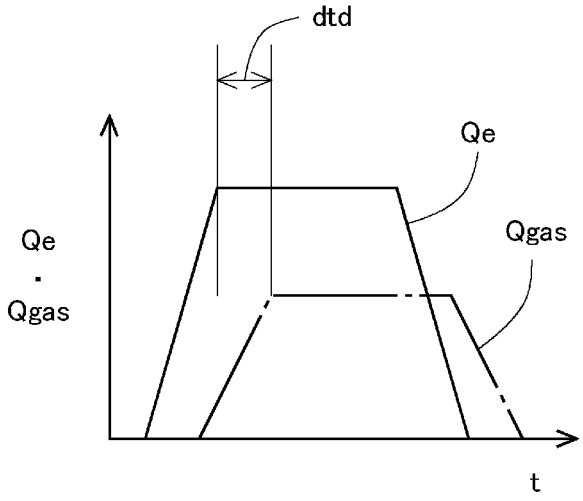

[Fig. 15]
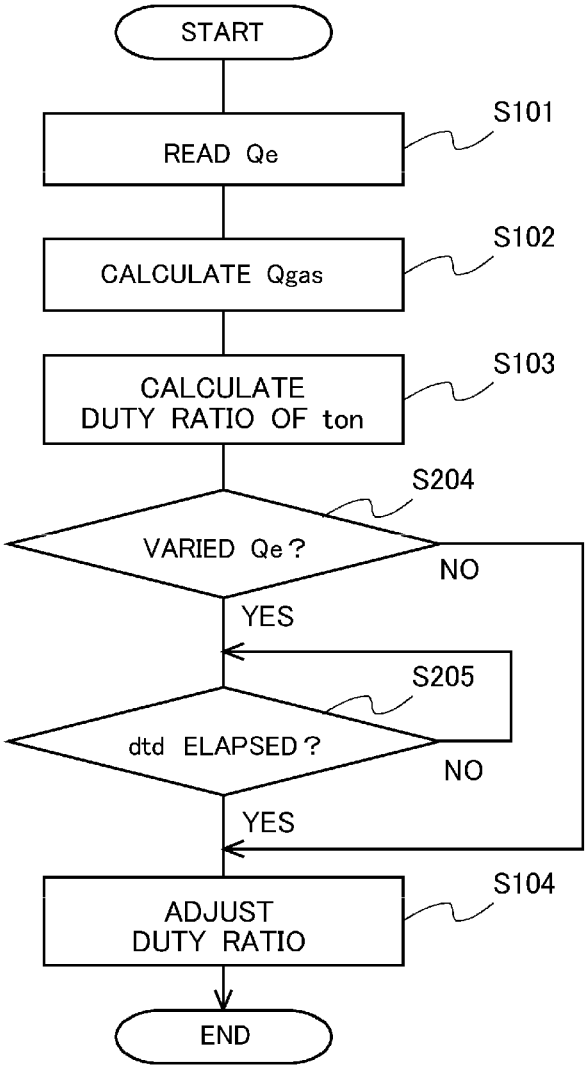

[Fig. 16]
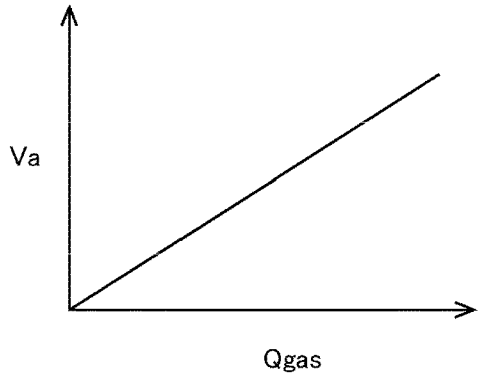
[Fig. 17]
(a)
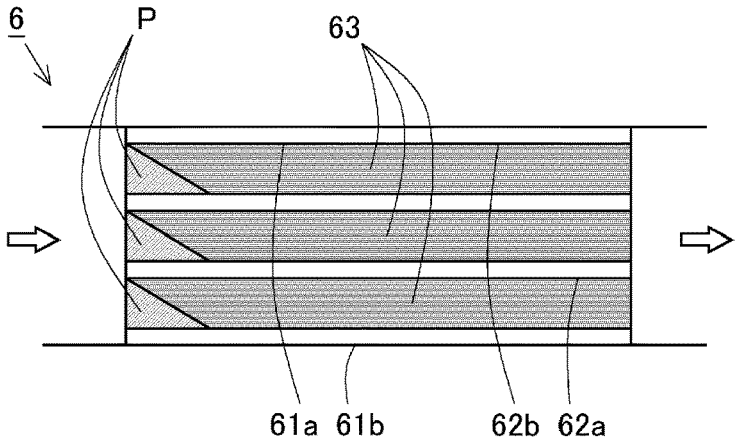
(b)
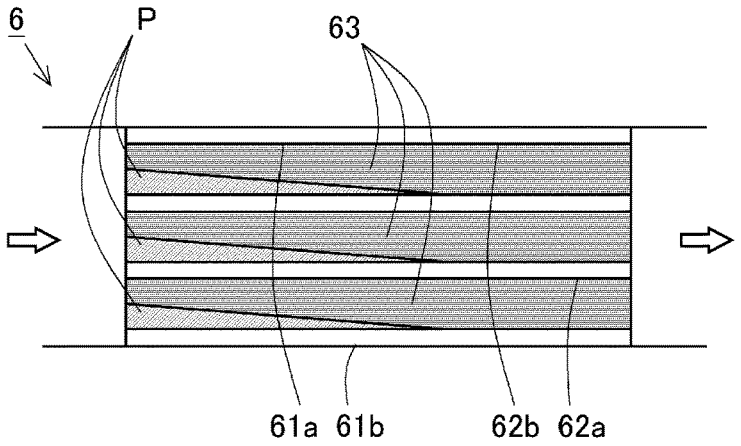

[Fig. 18]
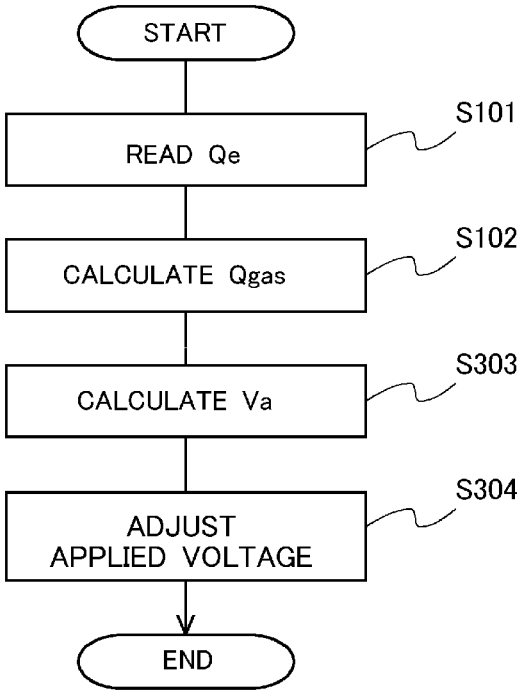

[Fig. 19]
(a)
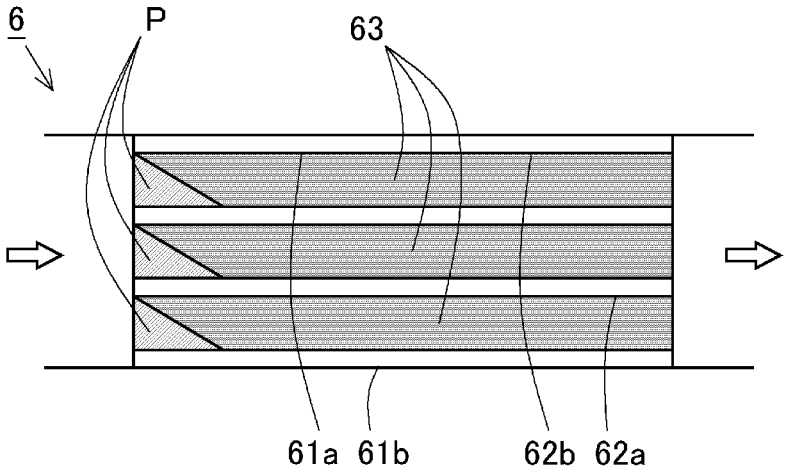
(b)
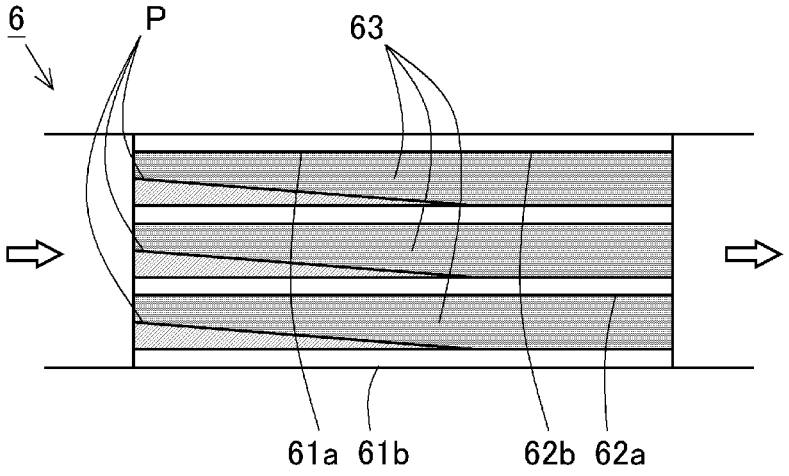

[Fig. 20]
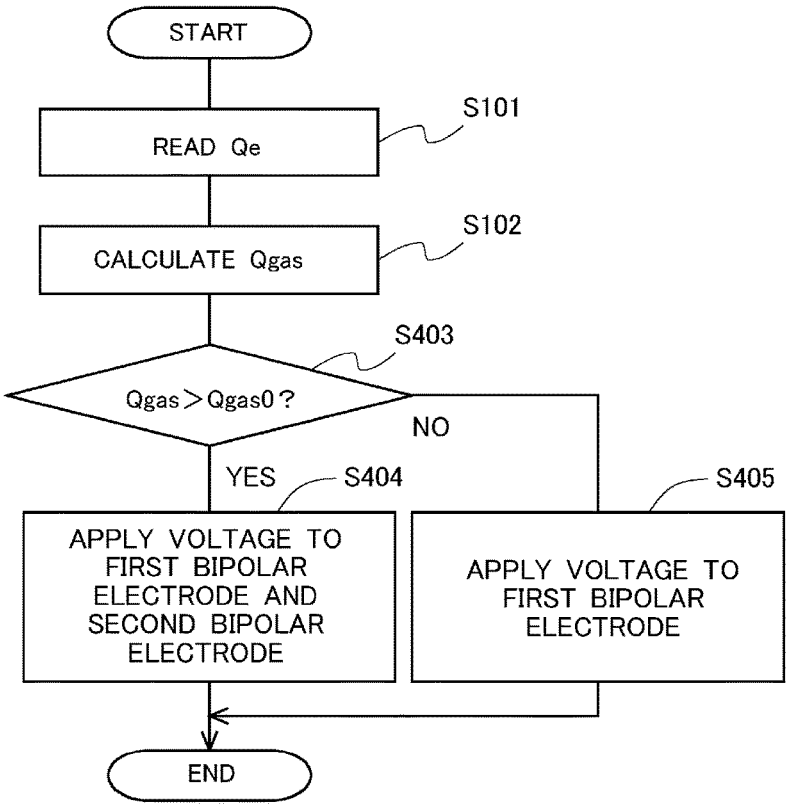
[Fig. 21]
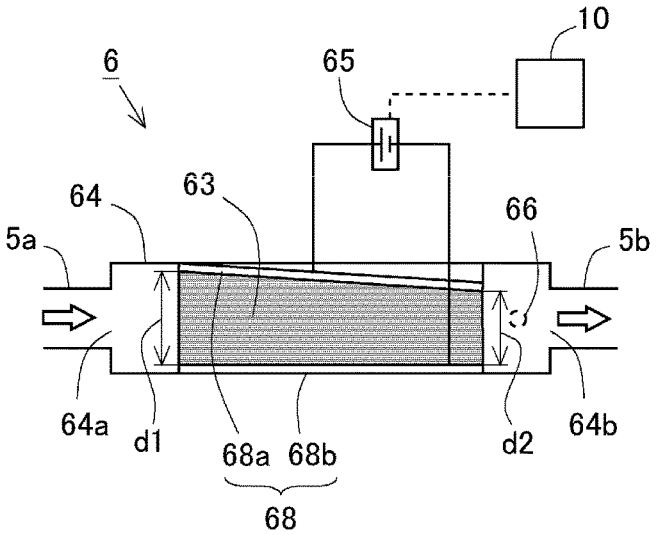

[Fig. 22]
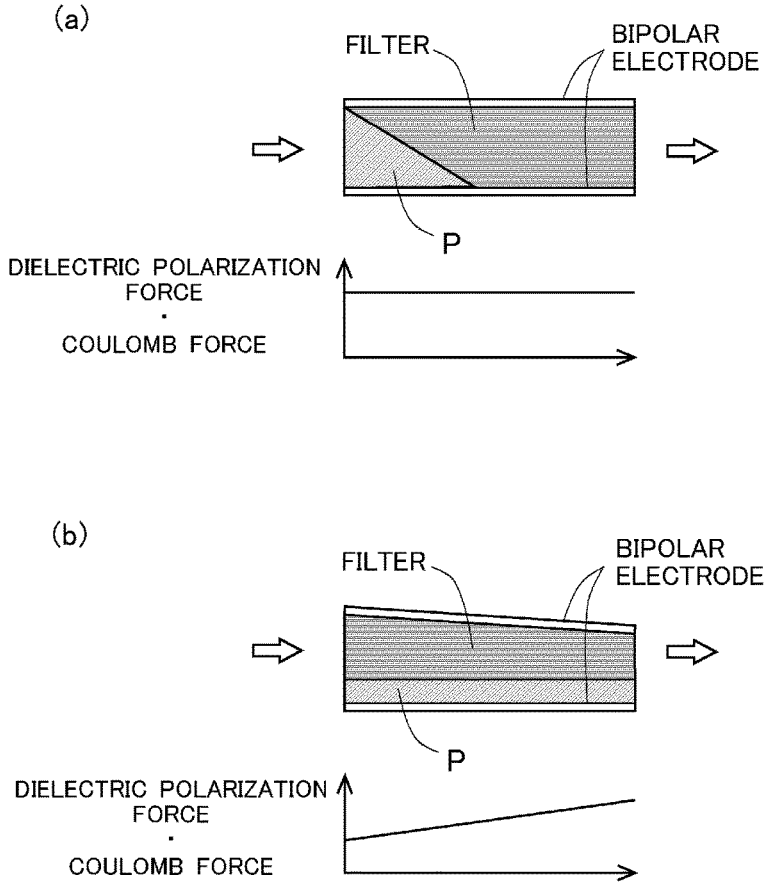
[Fig. 23]
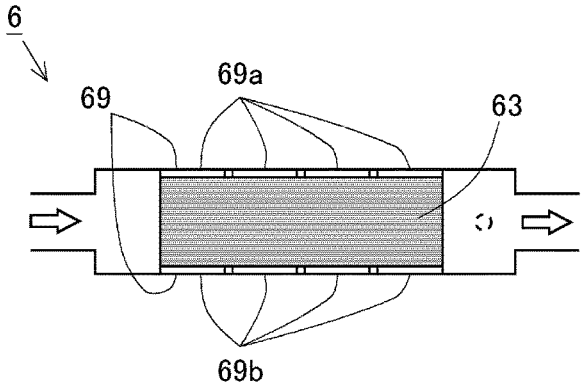

OIL REMOVAL APPARATUS

CROSS REFERENCE TO RELATED APPLICATIONS

This application is a National Stage of International Application No. PCT/JP2015/002072 filed Apr. 15, 2015, claiming priority based on Japanese Patent Application No. 2014-084034, filed Apr. 15, 2014, the contents of which are incorporated herein by reference in their entirety.

TECHNICAL FIELD

The present invention relates to an oil removal apparatus that removes oil particles (oil mist) contained in blow-by gas in an internal combustion engine.

BACKGROUND ART

In a conventional technique employed in an internal combustion engine, blow-by gas is recirculated to an intake system from a crank case through a blow-by gas passage. An oil removal apparatus that removes oil particles contained in the blow-by gas is provided in the blow-by gas passage. PTL 1, for example, discloses an electrostatic precipitator having a collector electrode that collects ionized oil mist within an electric field created by a pulse-driven high voltage corona discharge electrode.

Furthermore, NPL 1 discloses a microparticle removal unit used in a clean elevator of a clean room. This removal unit mainly removes microparticles believed to originate from oil using a dielectric filter method. The removal unit is structured such that a nonwoven fabric serving as a dielectric fiber layer is filled between an anode and a cathode of a parallel plate electrode. Dielectric polarization is generated in the nonwoven fabric by applying a voltage to the electrodes, and microparticles are collected in the nonwoven fabric using a dielectric polarization force that acts between the fibers and the microparticles in addition to Coulomb force acting on charged particles.

CITATION LIST

Patent Literature

[PTL 1]
Japanese Patent Application Publication No. 2005-334876

Non Patent Literature

[NPL 1]
Japan Association of Aerosol Science and Technology vol. 14 No. 4, 338-347 (1999)

SUMMARY OF INVENTION

Technical Problem

When a method using dielectric polarization of a filter is employed in an oil removal apparatus that removes oil particles contained in blow-by gas flowing through a blow-by gas passage of an internal combustion engine, the oil removal apparatus is configured such that a filter formed from a dielectric is disposed between an anode and a cathode extending in a flow direction of the blow-by gas of a bipolar electrode. With this configuration, dielectric polarization is generated in the filter by applying a voltage to the bipolar electrode such that dielectric polarization force acts on the oil particles flowing through the filter. Further, many of the oil particles contained in the blow-by gas are charged, and therefore, when a voltage is applied to the bipolar electrode, Coulomb force acts on the charged oil particles in addition to the dielectric polarization force. As a result, the oil particles are collected in the filter and thereby removed from the blow-by gas.

However, in an oil removal apparatus having a configuration such as that described above, when a voltage is applied constantly to the bipolar electrode in order to collect the oil particles contained in the blow-by gas in the filter, the dielectric polarization force and the Coulomb force act on the oil particles constantly as soon as the oil particles flow into the filter. The oil particles flowing into the filter are therefore likely to be collected in an upstream portion of the filter before reaching a downstream portion of the filter. In other words, more oil particles are likely to be collected in the upstream portion of the filter than in the downstream portion of the filter. As a result, a blockage may be caused by the oil particles in the upstream portion of the filter even though oil particles can still be collected in the downstream portion of the filter.

The present invention has been designed in consideration of this problem, and an object thereof is to provide a technique employed in an oil removal apparatus that collects oil particles in a filter disposed between an anode and a cathode, with which a blockage caused by the oil particles in an upstream portion of the filter can be suppressed.

Solution to Problem

According to a first invention, a voltage is applied intermittently to a bipolar electrode that generates dielectric polarization in a filter.

More specifically, an oil removal apparatus according to the present invention removes oil particles contained in blow-by gas flowing through a blow-by gas passage of an internal combustion engine, and includes:

a bipolar electrode having an anode and a cathode that extend in a flow direction of the blow-by gas;

a filter formed from a dielectric and disposed between the anode and the cathode of the bipolar electrode; and a control unit controlling application of a voltage to the bipolar electrode, wherein the control unit controls application of the voltage to the bipolar electrode such that while the internal combustion engine is operative, a voltage application period in which the voltage is applied to the bipolar electrode and a voltage application stoppage period in which application of the voltage to the bipolar electrode is stopped are repeated alternately at predetermined periodic intervals.

In the present invention, the voltage is applied to the bipolar electrode periodically. In other words, instead of applying a voltage to the bipolar electrode constantly, application of the voltage to the bipolar electrode and stoppage of the voltage applied to the bipolar electrode are repeated alternately while the internal combustion engine is operative. Here, the predetermined period is a time period assumed to be shorter than a period in which the oil particles flow out of the filter after flowing into the filter.

During the voltage application stoppage period, the dielectric polarization force and the Coulomb force do not act on the oil particles flowing into the filter. During this period, therefore, the oil particles flowing into the filter are unlikely to be collected in the upstream portion of the filter, and instead move through the filter from an upstream side to a downstream side together with the flow of the blow-by gas. When the voltage application period arrives while this movement is underway, the dielectric polarization force and the Coulomb force act on the oil particles flowing through the filter. As a result, the oil particles that have already passed through the upstream portion of the filter are collected in a part of the filter on the downstream side of the upstream portion.

According to the present invention, in other words, concentrated collection of the oil particles in the upstream portion of the filter is suppressed in comparison with a case where the voltage is applied to the bipolar electrode at all times. As a result, a blockage caused by the oil particles in the upstream portion of the filter can be suppressed. Moreover, according to the present invention, the oil particles are collected with using the entire filter from the upstream portion to the downstream portion along a flow of the blow-by gas. Therefore, a sufficient oil particle collection ratio (a ratio of an amount of collected oil particles relative to an amount of inflowing oil particles) can be secured over the entire filter.

Here, a flow speed of the oil particles flowing into the filter decreases as a flow rate of the blow-by gas flowing into the filter decreases. Accordingly, a time required for the oil particles flowing into the filter to pass through the upstream portion of the filter lengthens. Hence, assuming that a length of the voltage application period is constant, when the flow rate of the blow-by gas flowing into the filter is low, the amount of oil particles collected in the upstream portion of the filter during the voltage application period is greater than when the flow rate of the blow-by gas is high. In the present invention, therefore, a duty ratio of the voltage application period in which the voltage is applied to the bipolar electrode may be modified in accordance with the flow rate of the blow-by gas flowing into the filter. In other words, in the present invention, the control unit may make the duty ratio of the voltage application period smaller when the flow rate of the blow-by gas flowing into the filter is low than when the flow rate of the blow-by gas is high.

When the duty ratio of the voltage application period is small, a total time of the voltage application period during which the oil particles pass through the upstream portion of the filter shortens. According to the above description, therefore, when the flow rate of the blow-by gas flowing into the filter is low, the amount of oil particles collected in the upstream portion of the filter decreases. As a result, a blockage caused by the oil particles in the upstream portion of the filter can be suppressed even when the flow rate of the blow-by gas flowing into the filter is low. On the other hand, when the flow rate of the blow-by gas flowing into the filter is low, the oil particles flowing into the filter take a longer time to flow out of the filter than when the flow rate is high. Therefore, even when the duty ratio of the voltage application period is reduced, the voltage application period arrives while the oil particles that have already passed through the upstream portion of the filter during the voltage application stoppage period are still passing through the part of the filter on the downstream side of the upstream portion, and as a result, these oil particles are highly likely to be collected in the filter. Hence, in a case where the flow rate of the blow-by gas flowing into the filter is low, a sufficient oil particle collection ratio can be secured over the entire filter even when the duty ratio of the voltage application period is reduced.

Furthermore, according to the above description, when the flow rate of the blow-by gas flowing into the filter is high, the duty ratio of the voltage application period is larger than when the flow rate of the blow-by gas is low. As a result, a reduction in the total time of the voltage application period (in other words, the period in which the oil particles can be collected in the filter) during which the oil particles pass through the filter can be suppressed even when the flow rate of the blow-by gas increases, leading to an increase in the flow speed of the oil particles flowing into the filter. Therefore, a sufficient oil particle collection ratio can be secured over the entire filter even when the flow rate of the blow-by gas flowing into the filter is high.

Further, when an engine load of the internal combustion engine varies, a cylinder inner pressure and an internal pressure of an intake pipe also vary, leading to variation in the flow rate of the blow-by gas. In the present invention, therefore, the control unit may modify the duty ratio of the voltage application period in accordance with the engine load of the internal combustion engine.

Note, however, that a time lag occurs between variation in the engine load of the internal combustion engine and variation in the flow rate of the blow-by gas. Therefore, when the engine load of the internal combustion engine varies, the control unit may modify the duty ratio of the voltage application period after a predetermined delay time following the variation in the engine load. In so doing, the duty ratio of the voltage application period can be modified relative to actual variation in the flow rate of the blow-by gas flowing into the filter as possible.

According to a second invention, the voltage applied to the bipolar electrode is modified in accordance with the flow rate of the blow-by gas flowing into the filter.

More specifically, an oil removal apparatus according to the present invention removes oil particles contained in blow-by gas flowing through a blow-by gas passage of an internal combustion engine, and includes:

a bipolar electrode having an anode and a cathode that extend in a flow direction of the blow-by gas;

a filter formed from a dielectric and disposed between the anode and the cathode of the bipolar electrode; and a control unit that controls application of a voltage to the bipolar electrode, wherein the control unit makes the voltage applied to the bipolar electrode smaller when a flow rate of the blow-by gas flowing into the filter is low than when the flow rate of the blow-by gas is high.

When the flow rate of the blow-by gas decreases in a condition where a large enough voltage to ensure that a sufficient oil particle collection ratio can be secured over the entire filter even after an increase in the flow rate of the blow-by gas is applied to the bipolar electrode, the oil particle collection ratio in the upstream portion of the filter increases excessively, leading to an increase in the possibility of a blockage. According to the present invention, therefore, when the flow rate of the blow-by gas flowing into the filter is low, the voltage applied to the bipolar electrode is made smaller than when the flow rate of the blow-by gas is high.

Hence, when the flow rate of the blow-by gas flowing into the filter is low, the dielectric polarization force and Coulomb force that act on the oil particles flowing through the filter are smaller than when the flow rate of the blow-by gas flowing into the filter is high. According to the above description, therefore, when the flow rate of the blow-by gas flowing into the filter is low, the amount of oil particles collected in the upstream portion of the filter decreases. As a result, a blockage caused by the oil particles in the upstream portion of the filter can be suppressed even when the flow rate of the blow-by gas flowing into the filter is low.

Furthermore, according to the present invention, when the flow rate of the blow-by gas flowing into the filter is high, the voltage applied to the bipolar electrode is larger than when the flow rate of the blow-by gas is low. Accordingly, the dielectric polarization force and Coulomb force that act on the oil particles flowing through the filter become larger than when the flow rate of the blow-by gas flowing into the filter is low. As a result, a sufficient oil particle collection ratio can be secured over the entire filter even when the flow rate of the blow-by gas flowing into the filter is high.

According to a third invention, an anode and a cathode of a second bipolar electrode are provided between an anode and a cathode of a first bipolar electrode, a filter is disposed between the respective electrodes, and voltage application to the first bipolar electrode and the second bipolar electrode is controlled in accordance with the flow rate of the blow-by gas flowing into the filter.

More specifically, an oil removal apparatus according to the present invention removes oil particles contained in blow-by gas flowing through a blow-by gas passage of an internal combustion engine, and includes:

a first bipolar electrode having an anode and a cathode that extend in a flow direction of the blow-by gas;

a second bipolar electrode that is provided between the anode and the cathode of the first bipolar electrode, includes an anode and a cathode that extend in the flow direction of the blow-by gas, and is disposed such that the anode is positioned on the cathode side of the first bipolar electrode and the cathode is positioned on the anode side of the first bipolar electrode;

a filter formed from a dielectric and disposed between the anode of the first bipolar electrode and the cathode of the second bipolar electrode, between the cathode of the second bipolar electrode and the anode of the second bipolar electrode, and between the anode of the second bipolar electrode and the cathode of the first bipolar electrode; and a control unit that controls application of a voltage to the first bipolar electrode and the second bipolar electrode, wherein the control unit applies the voltage to the first bipolar electrode and the second bipolar electrode when a flow rate of the blow-by gas flowing into the filter is higher than a threshold, and applies the voltage only to the first bipolar electrode of the first bipolar electrode and the second bipolar electrode when the flow rate of the blow-by gas is equal to or lower than the threshold.

When the voltage is applied to the bipolar electrode, the dielectric polarization force and Coulomb force that act on the oil particles flowing through the filter disposed between the anode and the cathode decrease as a distance between the anode and the cathode lengthens. Therefore, in a case where the first bipolar electrode and the second bipolar electrode are disposed as described above, the dielectric polarization force and Coulomb force that act on the oil particles flowing through the filter are smaller when the voltage is applied to the first bipolar electrode alone than when the voltage is applied to both the first bipolar electrode and the second bipolar electrode.

Hence, in the present invention, the voltage is applied to the first bipolar electrode alone when the flow rate of the blow-by gas flowing into the filter is equal to or smaller than the threshold. As a result, the oil particles passing through the upstream portion of the filter are less likely to be collected in the filter. Therefore, a blockage caused by the oil particles in the upstream portion of the filter can be suppressed even when the flow rate of the blow-by gas flowing into the filter is low. Further, as described above, when the flow rate of the blow-by gas flowing into the filter is low, the oil particles flowing into the filter take a longer time to flow out of the filter than when the flow rate is high. Therefore, even when the first bipolar electrode is set as the only bipolar electrode to which the voltage is applied, leading to a reduction in the dielectric polarization force and Coulomb force acting on the oil particles, the proportion of the oil particles that are collected in the part of the filter on the downstream side of the upstream portion after passing through the upstream portion of the filter increases. As a result, a sufficient oil particle collection ratio is secured over the entire filter even when the flow rate of the blow-by gas flowing into the filter is equal to or lower than the threshold such that the first bipolar electrode is set as the only bipolar electrode to which the voltage is applied.

Furthermore, in the present invention, the voltage is applied to both the first bipolar electrode and the second bipolar electrode when the flow rate of the blow-by gas flowing into the filter is higher than the threshold, and as a result, the dielectric polarization force and Coulomb force acting on the oil particles become larger than when the flow rate of the blow-by gas is low. It is therefore possible to secure a sufficient oil particle collection ratio over the entire filter even when the flow rate of the blow-by gas flowing into the filter is higher than the threshold.

According to a fourth invention, the bipolar electrode is configured such that the distance between the anode and the cathode is shorter in the downstream portion in the flow direction of the blow-by gas than in the upstream portion.

More specifically, an oil removal apparatus according to the present invention removes oil particles contained in blow-by gas flowing through a blow-by gas passage of an internal combustion engine, and includes:

a bipolar electrode having an anode and a cathode that extend in a flow direction of the blow-by gas;

a filter formed from a dielectric and disposed between the anode and the cathode of the bipolar electrode; and a voltage application unit that applies a voltage to the bipolar electrode, wherein a distance between the anode and the cathode of the bipolar electrode is shorter in a downstream portion than in an upstream portion in the flow direction of the blow-by gas.

As described above, when the voltage is applied to the bipolar electrode, the dielectric polarization force and Coulomb force that act on the oil particles flowing through the filter disposed between the anode and the cathode decrease as the distance between the anode and the cathode lengthens. Therefore, in a case where the bipolar electrode is configured as described above, the dielectric polarization force and Coulomb force that act on the oil particles flowing through the filter are smaller in the upstream portion of the filter in the flow direction of the blow-by gas than in the downstream portion of the filter. As a result, the oil particles are less likely to be collected in the upstream portion of the filter. According to the present invention, therefore, a blockage caused by the oil particles in the upstream portion of the filter can be suppressed. Further, in the downstream portion of the filter, the dielectric polarization force and Coulomb force that act on the oil particles flowing through the filter are larger than in the upstream portion of the filter. Therefore, the oil particles that have passed through the upstream portion of the filter are likely to be collected in the downstream portion of the filter. As a result, a sufficient oil particle collection ratio can be secured over the entire filter.

The present invention may also be taken as an internal combustion engine including the oil removal apparatus according to any one of the first to fourth inventions described above.

Advantageous Effects of Invention

According to the present invention, in an oil removal apparatus that collects oil particles in a filter disposed between an anode and a cathode, a blockage caused by the oil particles in an upstream portion of the filter can be suppressed.

BRIEF DESCRIPTION OF DRAWINGS

FIG. 1 is a schematic view showing a configuration of an internal combustion engine, and an intake/exhaust system thereof, according to an embodiment.

FIG. 2 is a schematic view showing a configuration of an oil removal apparatus according to a first embodiment.

FIG. 3 is a view showing an oil particle collection ratio of the oil removal apparatus.

FIG. 4 is a view showing a distribution of an amount of oil particles collected in a filter in a case where a voltage is applied constantly to a bipolar electrode of the oil removal apparatus.

FIG. 5 is a time chart showing a transition of the voltage applied to the bipolar electrode of the oil removal apparatus according to the first embodiment.

FIG. 6 is a view showing the distribution of the amount of oil particles collected in the filter in a case where voltage application control such as that illustrated in FIG. 5 is executed.

FIG. 7 is a schematic view showing a configuration of an oil removal apparatus according to a modified example of the first embodiment.

FIG. 8 is a second view showing a distribution of an amount of oil particles collected in a filter in a case where a voltage is applied constantly to a bipolar electrode of the oil removal apparatus.

FIG. 9 is a time chart showing a transition of a voltage applied to a bipolar electrode of an oil removal apparatus according to a second embodiment.

FIG. 10 is a view showing the distribution of the amount of oil particles collected in the filter in a case where duty ratio control such as that illustrated in FIG. 9 is executed.

FIG. 11 is a flowchart showing a flow of voltage application control according to the second embodiment.

FIG. 12 is a view showing a relationship between an engine load Qe of the internal combustion engine and a flow rate Qgas of blow-by gas.

FIG. 13 is a view showing a relationship between the flow rate Qgas of the blow-by gas and a duty ratio of a voltage application period ton according to the first embodiment.

FIG. 14 is a time chart showing transitions of the engine load Qe of the internal combustion engine and the flow rate Qgas of the blow-by gas flowing into the filter.

FIG. 15 is a flowchart showing a flow of voltage application control according to a modified example of the second embodiment.

FIG. 16 is a view showing a relationship between the flow rate Qgas of the blow-by gas and a voltage Va applied to a bipolar electrode according to a third embodiment.

FIG. 17 is a view illustrating a distribution of an amount of oil particles collected in a filter according to the third embodiment.

FIG. 18 is a flowchart showing a flow of voltage application control according to the third embodiment.

FIG. 19 is a view illustrating a distribution of an amount of oil particles collected in a filter according to a fourth embodiment.

FIG. 20 is a flowchart showing a flow of voltage application control according to the fourth embodiment.

FIG. 21 is a schematic view showing a configuration of an oil removal apparatus according to a fifth embodiment.

FIG. 22 is a view illustrating a distribution of an amount of oil particles collected in a filter according to the fifth embodiment.

FIG. 23 is a schematic view showing a configuration of an oil removal apparatus according to a reference example.

DESCRIPTION OF EMBODIMENTS

Specific embodiments of the present invention will be described below on the basis of the drawings. Unless specified otherwise, the technical scope of the present invention is not limited to the dimensions, materials, shapes, relative arrangements, and so on of constituent components described in the embodiments.

(First Embodiment)

An embodiment of a case in which the oil removal apparatus according to the present invention is applied to a diesel engine will be described. Note that the oil removal apparatus according to the present invention is not limited to a diesel engine, and may be employed in another engine that uses oil (lubricating oil), such as a gasoline engine.

(Configuration of Internal Combustion Engine and Intake/Exhaust System Thereof)

FIG. 1 is a schematic view showing a configuration of the internal combustion engine and an intake/exhaust system thereof according to this embodiment. An internal combustion engine 1 is a diesel engine installed in a vehicle. An intake passage 2 and an exhaust passage 3 are connected to the internal combustion engine 1. A compressor 4*a* of a turbocharger 4 is provided midway in the intake passage 2. A turbine 4*b* of the turbocharger 4 is provided midway in the exhaust passage 3.

An electronic control unit (ECU) 10 is provided alongside the internal combustion engine 1. A crank position sensor 11 and an accelerator operation amount sensor 12 are electrically connected to the ECU 10. The crank position sensor 11 detects a rotation position of an output shaft (a crankshaft) of the internal combustion engine 1. The accelerator operation amount sensor 12 detects an accelerator operation amount of the vehicle in which the internal combustion engine 1 is installed. Output signals from the respective sensors are input into the ECU 10. The ECU 10 calculates an engine load of the internal combustion engine 1 on the basis of an output value from the accelerator operation amount sensor 12. Further, the ECU 10 calculates an engine rotation speed of the internal combustion engine 1 on the basis of an output value from the crank position sensor 11.

The internal combustion engine 1 is further provided with a blow-by gas passage 5. One end of the blow-by gas passage 5 communicates with a crank case of the internal combustion engine 1. The blow-by gas passage 5 extends through a cylinder head cover of the internal combustion engine 1 such that the other end thereof is connected to the intake passage 2 on an upstream side of the compressor 4*a*. Blow-by gas is recirculated to the intake passage 2 from the crank case through the blow-by gas passage 5.

The blow-by gas contains oil particles (oil mist) generated when oil is scattered in the internal combustion engine 1.

Hence, an oil removal apparatus 6 is provided in the blow-by gas passage 5 within the cylinder head of the internal combustion engine 1 in order to remove the oil particles contained in the blow-by gas.

(Configuration of Oil Removal Apparatus)

FIG. 2 is a schematic view showing a configuration of the oil removal apparatus 6 according to this embodiment. FIG. 2 is also a schematic diagram of the oil removal apparatus 6 as viewed from top. Further, black-outlined arrows in FIG. 2 denote the flow of the blow-by gas.

A first bipolar electrode 61, a second bipolar electrode 62, and a filter 63 are provided in a case 64 of the oil removal apparatus 6. An upstream side (crank case side) blow-by gas passage 5*a* is connected to a gas inlet 64*a* of the case 64. The blow-by gas flows into the case 64 from the blow-by gas passage 5*a* through the gas inlet 64*a*. A downstream side (intake passage side) blow-by gas passage 5*b* is connected to a gas outlet 64*b* of the case 64. The blow-by gas flows out of the case 64 into the blow-by gas passage 5*b* through the gas outlet 64*b*.

The first bipolar electrode 61 is a parallel plate electrode including an anode 61*a* and a cathode 61*b* that extend in a flow direction of the blow-by gas. The second bipolar electrode 62 is a parallel plate electrode including an anode 62*a* and a cathode 62*b* that extend in the flow direction of the blow-by gas, and is provided between the anode 61*a* and the cathode 61*b* of the first bipolar electrode 61. The anode 62*a* of the second bipolar electrode 62 is positioned on the side of the cathode 61*b* of the first bipolar electrode 61, while the cathode 62*b* of the second bipolar electrode 62 is positioned on the side of the anode 61*a* of the first bipolar electrode 61. In other words, the respective electrodes are disposed such that the anode 61*a* of the first bipolar electrode 61 and the cathode 62*b* of the second bipolar electrode 62 face each other, and the cathode 61*b* of the first bipolar electrode 61 and the anode 62*a* of the second bipolar electrode 62 face each other.

The filter 63 is provided between the anode 61*a* of the first bipolar electrode 61 and the cathode 62*b* of the second bipolar electrode 62, between the cathode 62*b* of the second bipolar electrode 62 and the anode 62*a* of the second bipolar electrode 62, and between the anode 62*a* of the second bipolar electrode 62 and the cathode 61*b* of the first bipolar electrode 61. The filter 63 is formed from a dielectric of, for example, polyethylene terephthalate (PET) or glass fiber. Further, to reduce pressure loss, a filter having a small filling factor (a filling factor of approximately 0.014 (1.4%), for example) is employed as the filter 63.

Furthermore, a drain passage 66 is connected to a lower side of the case 64 on a downstream side of the part in which the bipolar electrodes 61, 62 and the filters 63 are disposed. The drain passage 66 communicates with the interior of the cylinder head of the internal combustion engine 1. Recovered oil collected by the filters 63 is returned to the internal combustion engine 1 through the drain passage 66.

The respective bipolar electrodes 61, 62 are electrically connected to a power supply 65 that applies a voltage to the bipolar electrodes 61, 62. The power supply 65 is electrically connected to the ECU 10. Voltage application to the respective bipolar electrodes 61, 62 is controlled by the ECU 10.

Note that in the oil removal apparatus according to this embodiment, a configuration employing two bipolar electrode sets, namely the first and second bipolar electrodes 61, 62, is employed. However, the oil removal apparatus according to the present invention is not limited to this electrode configuration, and a configuration having a single bipolar electrode set or a configuration having three or more bipolar electrode sets may be employed instead.

A mechanism by which the oil particles contained in the blow-by gas are collected in the oil removal apparatus according to this embodiment will now be described. In the oil removal apparatus 6, as described above, the filling factor of the filter 63 is small, and therefore, when no voltage is applied to the bipolar electrodes 61, 62, substantially none of the oil particles contained in the blow-by gas are collected in the filters 63. When a voltage is applied to the bipolar electrodes 61, 62, however, dielectric polarization force and Coulomb force act on the oil particles, and as a result, the oil particles are collected in the filters 63.

FIG. 3 is a view showing an oil particle collection ratio of the oil removal apparatus. A solid line in FIG. 3 shows the oil particle collection ratio when a voltage is applied to the electrodes of an oil removal apparatus configured such that a filter formed from a dielectric and having a small filling factor, as in this embodiment, is provided between the anode and the cathode. Further, a dotted line in FIG. 3 shows the oil particle collection ratio when a voltage is applied to the electrodes of an oil removal apparatus configured such that a filter is not provided between the anode and the cathode. The solid line and the dotted line in FIG. 3 show the collection ratio in cases where an identical predetermined voltage is applied to the electrodes of both oil removal apparatuses. Note that in FIG. 3, the ordinate shows the oil particle collection ratio of the oil removal apparatus, and the abscissa shows a particle size of the oil particles.

As shown by the dotted line in FIG. 3, even with the configuration in which a filter is not provided between the anode and the cathode, when the predetermined voltage is applied to the electrodes, an oil particle collection ratio of at least 50% is obtained, regardless of the particle size of the oil particles. In other words, a part of the oil particles contained in the blow-by gas is collected by the electrodes even when a filter is not provided between the anode and the cathode. The reason for this is that when oil in respective operating parts of the internal combustion engine turns into mist, many of the oil particles are charged, and therefore many of the oil particles in the blow-by gas are charged. Hence, when a voltage is applied to the bipolar electrodes in the oil removal apparatus, Coulomb force acts on the charged oil particles.

Further, as shown by the solid line in FIG. 3, with the configuration in which the filter is provided between the anode and the cathode, the oil particle collection ratio of the oil removal apparatus improves in comparison with the configuration in which a filter is not provided between the anode and the cathode such that a collection ratio of approximately 90% is obtained. The reason for this is that when a voltage is applied to the bipolar electrodes, dielectric polarization occurs in the filter formed from a dielectric, and therefore dielectric polarization force acts on the oil particles contained in the blow-by gas in addition to the Coulomb force, with the result that the oil particles are collected in the filter. The Coulomb force acts only on the charged oil particles, whereas the dielectric polarization force also acts between uncharged oil particles and the filter. Therefore, not only the charged oil particles but also the uncharged oil particles are collected in the filter. Furthermore, the force acting on the uncharged oil particles increases by applying the dielectric polarization force to the uncharged oil particles in addition to the Coulomb force. Hence, with the configuration in which the filter is provided between the anode and the cathode, even though the filter has such a small filling factor that substantially no oil particles are collected therein when no voltage is applied to the electrodes, the oil particle collection ratio of the oil removal apparatus is higher than with the configuration in which the filter is not provided between the anode and the cathode.

(Voltage Application Control)

Next, control of the voltage applied to the bipolar electrode of the oil removal apparatus according to this embodiment will be described. FIG. 4 is a view showing a distribution of an amount of oil particles collected in the filter 63 in a case where the voltage is applied constantly to the bipolar electrodes 61, 62. Likewise in FIG. 4, black-outlined arrows denote the flow of the blow-by gas. Further, in FIG. 4, shaded portions P denote the oil particles collected in the filter 63. Note that the shaded portions P are merely images representing the amount of oil particles collected in the positions of the shaded portions P, and do not indicate a manner in which the oil particles are actually collected.

Here, when the voltage is applied constantly to the bipolar electrodes 61, 62, the dielectric polarization force and the Coulomb force act on the oil particles as soon as the oil particles flow into the filter 63. The oil particles flowing into the filter 63 are therefore likely to be collected in an upstream portion of the filter 63 before reaching a downstream portion of the filter 63. In other words, more oil particles are likely to be collected in the upstream portion of the filter 63 than in the downstream portion. Hence, when the voltage is applied constantly to the bipolar electrodes 61, 62, as shown in FIG. 4, a blockage may be caused by the oil particles in the upstream portion of the filter 63 even though oil particles can still be collected in the downstream portion of the filter 63.

In this embodiment, therefore, the voltage is applied to the bipolar electrodes 61, 62 intermittently by controlling the power supply 65 using the ECU 10. FIG. 5 is a time chart showing a transition of the voltage applied to the bipolar electrodes 61, 62 according to this embodiment. As shown in FIG. 5, in this embodiment, instead of applying the voltage to the bipolar electrodes 61, 62 constantly, voltage application to the bipolar electrodes 61, 62 is controlled such that while the internal combustion engine 1 is operative, a voltage application period ton in which the voltage is applied to the bipolar electrodes 61, 62 and a voltage application stoppage period off in which application of the voltage to the bipolar electrodes 61, 62 is stopped are repeated alternately at predetermined periodic intervals tc. Note that the predetermined period tc is determined in advance on the basis of experiments and the like as a time period assumed to be shorter than a period in which the oil particles flow out of the filter 63 after flowing into the filter 63.

FIG. 6 is a view showing the distribution of the amount of oil particles collected in the filter 63 in a case where voltage application control such as that shown in FIG. 5 is executed. Likewise in FIG. 6, black-outlined arrows denote the flow of the blow-by gas. Further, in FIG. 6, the shaded portions P denote the oil particles collected in the filter 63. Note that the shaded portions P are merely images representing the amount of oil particles collected in the positions of the shaded portions P, and do not indicate the manner in which the oil particles are actually collected.

During the voltage application stoppage period toff within the period tc in which the voltage is applied to the bipolar electrodes 61, 62, the dielectric polarization force and Coulomb force do not act on the oil particles flowing through the filter 63. During this period, therefore, the oil particles flowing into the filter 63 are unlikely to be collected in the upstream portion of the filter 63, and instead move through the filter 63 from an upstream side to a downstream side. When the voltage application period ton arrives while this movement is underway, the dielectric polarization force and Coulomb force act on the oil particles flowing through the filter 63. As a result, the oil particles that have already passed through the upstream portion of the filter 63 during the voltage application stoppage period toff are collected in the filter 63 on the downstream side of the upstream portion during the voltage application period ton.

With the voltage application control according to this embodiment, in other words, concentrated collection of the oil particles in the upstream portion of the filter 63 is suppressed in comparison with a case where the voltage is applied to the bipolar electrodes 61, 62 at all times, and instead the oil particles are collected with using the entire filter 63 from the upstream portion to the downstream portion along a flow of the blow-by gas. As shown in FIG. 6, therefore, in comparison with a case such as that shown in FIG. 4, in which the voltage is applied constantly to the bipolar electrodes 61, 62, the amount of oil particles collected in the upstream portion of the filter 63 decreases and an amount of oil particles collected in the downstream portion of the filter 63 increases. As a result, a blockage caused by the oil particles in the upstream portion of the filter 63 can be suppressed. Furthermore, a sufficient oil particle collection ratio can be secured over the entire filter 63.

(Modified Example)

FIG. 7 is a schematic view showing a configuration of an oil removal apparatus according to a modified example of this embodiment. The oil removal apparatus according to this modified example differs from the embodiment described above in the configuration of the filter. According to this modified example, in the respective upstream portions of the bipolar electrodes 61, 62, a filter 67 is not provided between the anode 61*a* of the first bipolar electrode 61 and the cathode 62*b* of the second bipolar electrode 62, between the cathode 62*b* of the second bipolar electrode 62 and the anode 62*a* of the second bipolar electrode 62, and between the anode 62*a* of the second bipolar electrode 62 and the cathode 61*b* of the first bipolar electrode 61. Note that in this modified example, voltage application control is executed in a similar manner to the above embodiment.

With the configuration according to this modified example, when the voltage application period ton arrives while the uncharged oil particles are passing through the upstream portions (the parts in which the filter 67 is not provided) of the bipolar electrodes 61, 62, the uncharged oil particles are at least partially charged. As a result, a proportion of charged oil particles within the oil particles flowing into the filter 67 increases. As described above, both dielectric polarization force and Coulomb force act on the charged particles in the filter 67 during the voltage application period ton. Therefore, the charged oil particles are more likely than the uncharged oil particles to be collected in the filter 67 while passing through the filter 67. Hence, according to this modified example, the oil particle collection ratio of the filter 67 can be improved.

(Second Embodiment)

An internal combustion engine and an intake/exhaust system thereof according to this embodiment are configured identically to the above first embodiment. The oil removal apparatus according to this embodiment is also configured similarly to the above first embodiment. The following description focuses on parts of this embodiment that differ from the first embodiment.

FIG. 8 is a view showing the distribution of the amount of oil particles collected in the filter 63 in a case where the voltage is applied constantly to the bipolar electrodes 61, 62. FIG. 8(*a*) shows the distribution of the amount of collected oil particles when a flow rate of the blow-by gas is comparatively low, and FIG. 8(*b*) shows the distribution of the amount of collected oil particles when the flow rate of the blow-by gas is comparatively high. Likewise in FIG. 8, black-outlined arrows denote the flow of the blow-by gas. Further, in FIG. 8, the shaded portions P denote the oil particles collected in the filter 63. Note that the shaded portions P are merely images representing the amount of oil particles collected in the positions of the shaded portions P, and do not indicate the manner in which the oil particles are actually collected.

As described above, when the voltage is applied constantly to the bipolar electrodes 61, 62, more oil particles are likely to be collected in the upstream portion of the filter 63 than in the downstream portion. This applies regardless of the flow rate of the blow-by gas. However, a flow speed of the oil particles flowing into the filter 63 decreases as the flow rate of the blow-by gas flowing into the filter 63 decreases. Accordingly, a time required for the oil particles flowing into the filter 63 to pass through the upstream portion of the filter 63 lengthens. Hence, assuming that a length of the voltage application period ton is constant, when the flow rate of the blow-by gas flowing into the filter 63 is low, the amount of oil particles collected in the upstream portion of the filter 63 during the voltage application period ton is greater than when the flow rate of the blow-by gas is high. In other words, as shown in FIG. 8, when the flow rate of the blow-by gas is low, the oil particles are more likely to be collected intensively in the upstream portion of the filter 63 than when the flow rate of the blow-by gas is high.

(Duty Ratio Control)

Hence, during the voltage application control according to this embodiment, as well as repeating the voltage application period ton and the voltage application stoppage period off alternately at predetermined periodic intervals tc, a duty ratio of the voltage application period ton is modified in accordance with the flow rate of the blow-by gas flowing into the filter 63. FIG. 9 is a time chart showing a transition of the voltage applied to the bipolar electrodes 61, 62 according to this embodiment. In FIG. 9, dotted lines show the transition in a case where the flow rate of the blow-by gas flowing into the filter 63 is comparatively high, and solid lines show the transition in a case where the flow rate of the blow-by gas flowing into the filter 63 is comparatively low. In this embodiment, as shown in FIG. 9, the duty ratio of the voltage application period ton is made smaller when the flow rate of the blow-by gas flowing into the filter 63 is low than when the flow rate of the blow-by gas is high.

FIG. 10 is a view showing the distribution of the amount of oil particles collected in the filter 63 in a case where duty ratio control such as that illustrated in FIG. 9 is executed. FIG. 10(*a*) shows the distribution in a case where the flow rate of the blow-by gas is comparatively low, and FIG. 10(*b*) shows the distribution in a case where the flow rate of the blow-by gas is comparatively high. Likewise in FIG. 10, black-outlined arrows denote the flow of the blow-by gas. Further, in FIG. 10, the shaded portions P denote the oil particles collected in the filter 63. Note that the shaded portions P are merely images representing the amount of oil particles collected in the positions of the shaded portions P, and do not indicate the manner in which the oil particles are actually collected.

When the duty ratio of the voltage application period ton is reduced, a total time of the voltage application period during which the oil particles pass through the upstream portion of the filter 63 shortens. Accordingly, the amount of oil particles collected in the upstream portion of the filter 63 decreases. In other words, the oil particle collection ratio in the upstream portion of the filter 63 decreases. As shown in FIG. 10(*a*), therefore, by reducing the duty ratio of the voltage application period ton even when the flow rate of the blow-by gas flowing into the filter 63 is low, a blockage caused by the oil particles in the upstream portion of the filter 63 can be suppressed.

On the other hand, when the flow rate of the blow-by gas flowing into the filter 63 is low, the oil particles flowing into the filter 63 take a longer time to flow out of the filter 63 than when the flow rate is high. Therefore, even when the duty ratio of the voltage application period ton is reduced, the voltage application period arrives while the oil particles that have already passed through the upstream portion of the filter 63 during the voltage application stoppage period toff are still passing through the part of the filter 63 on the downstream side of the upstream portion, and as a result, these oil particles are highly likely to be collected in the filter 63. In other words, when the duty ratio of the voltage application period ton is reduced, the oil particles that would have been collected in the upstream portion of the filter 63 had the duty ratio of the voltage application period ton remained large are collected in the part of the filter 63 downstream of the upstream portion. Hence, in a case where the flow rate of the blow-by gas flowing into the filter 63 is low, a sufficient oil particle collection ratio can be secured over the entire filter 63 even when the duty ratio of the voltage application period ton is reduced.

Furthermore, in the voltage application control according to this embodiment, when the flow rate of the blow-by gas flowing into the filter 63 is high, the duty ratio of the voltage application period ton is made larger than when the flow rate of the blow-by gas is low. As a result, a reduction in the total time of the voltage application period during which the oil particles pass through the filter 63 can be suppressed even when the flow rate of the blow-by gas increases, leading to an increase in the flow speed of the oil particles flowing into the filter 63. As shown in FIG. 10(*b*), therefore, a sufficient oil particle collection ratio can be secured over the entire filter 63 even when the flow rate of the blow-by gas flowing into the filter 63 is high.

(Flow of Voltage Application Control)

FIG. 11 is a flowchart showing a flow of the voltage application control according to this embodiment. This flow is stored in the ECU 10 and executed repeatedly by the ECU 10 at predetermined intervals while the internal combustion engine 1 is operative (or while a condition on which to execute removal of the oil particles contained in the blow-by gas is established).

In this flow, first, in step S101, an engine load Qe of the internal combustion engine 1 is read. Next, in step S102, a flow rate Qgas of the blow-by gas flowing into the filter 63 is calculated on the basis of the engine load Qe of the internal combustion engine 1, read in step S101. The flow rate Qgas of the blow-by gas flowing into the filter 63 varies in accordance with the engine load Qe of the internal combustion engine 1. FIG. 12 is a view showing a relationship between the engine load Qe of the internal combustion engine 1 and the flow rate Qgas of the blow-by gas. As the engine load of the internal combustion engine 1 increases, a cylinder inner pressure of the internal combustion engine 1 increases, and a negative pressure in a part of the intake passage 2 to which the blow-by gas passage 5 is connected (a part on the upstream side of the compressor 4*a*) also increases. As shown in FIG. 12, therefore, the flow rate Qgas of the blow-by gas increases as the engine load Qe of the internal combustion engine 1 increases. A relationship such as that shown in FIG. 12 between the engine load Qe of the internal combustion engine 1 and the flow rate Qgas of the blow-by gas is stored in the ECU 10 in advance in the form of a map or a function. Then, in step S102, the flow rate Qgas of the blow-by gas is calculated using the map or function.

Next, in step S103, the duty ratio of the voltage application period ton is calculated on the basis of the flow rate Qgas of the blow-by gas, calculated in step S102. FIG. 13 is a view showing a relationship between the flow rate Qgas of the blow-by gas and the duty ratio of the voltage application period ton. In this embodiment, as shown in FIG. 13, the duty ratio of the voltage application period ton decreases as the flow rate Qgas of the blow-by gas decreases. A relationship such as that shown in FIG. 13 between the flow rate Qgas of the blow-by gas and the duty ratio of the voltage application period ton is stored in the ECU 10 in advance in the form of a map or a function. Then, in step S103, the duty ratio of the voltage application period ton is calculated using the map or function.

Next, in step S104, a duty ratio of the voltage application control is adjusted such that the duty ratio of the voltage application period ton reaches the value calculated in step S103.

Note that the flow rate of the blow-by gas also varies according to an engine rotation speed of the internal combustion engine 1. As the engine rotation speed increases, a clearance becomes more likely to form between a piston ring and a bore wall surface in a cylinder of the internal combustion engine 1. As a result, the flow rate of the blow-by gas increases. In step S101, therefore, the flow rate of the blow-by gas may be calculated using both the engine load and the engine rotation speed of the internal combustion engine 1 as parameters. In so doing, the flow rate of the blow-by gas can be calculated more accurately. Note, however, that variation in the engine load of the internal combustion engine 1 has a greater effect on the flow rate of the blow-by gas than variation in the engine rotation speed of the internal combustion engine 1. Therefore, the flow rate of the blow-by gas may be calculated on the basis of the engine load of the internal combustion engine 1 alone, as in the above embodiment.

Furthermore, in this embodiment, when a cylinder inner pressure sensor that detects the cylinder inner pressure of the internal combustion engine 1 or an intake pipe pressure sensor that detects an intake pipe pressure in the part of the intake passage 2 to which the blow-by gas passage 5 is connected (the part on the upstream side of the compressor 4*a*) is provided, the flow rate Qgas of the blow-by gas flowing into the filter 63 may be calculated on the basis of respective output values from these sensors. Moreover, instead of estimating the flow rate Qgas of the blow-by gas flowing into the filter 63, the duty ratio of the voltage application period ton may be controlled on the basis of at least one parameter that correlates with the flow rate Qgas of the blow-by gas, such as the engine load or cylinder inner pressure of the internal combustion engine 1, or the intake pipe pressure in the part of the intake passage 2 to which the blow-by gas passage 5 is connected.

Furthermore, the duty ratio of the voltage application period ton does not necessarily have to be varied continuously in response to variation in the flow rate Qgas of the blow-by gas, as shown in FIG. 13, and instead, the duty ratio of the voltage application period ton may be varied in stages in response to variation in the flow rate Qgas of the blow-by gas.

(Modified Example)

Voltage application control according to a modified example of this embodiment will now be described. FIG. 14 is a time chart showing transitions of the engine load Qe of the internal combustion engine 1 and the flow rate Qgas of the blow-by gas flowing into the filter 63. In FIG. 14, a solid line shows the transition of the engine load Qe of the internal combustion engine 1, and a dot-dash line shows the transition of the flow rate Qgas of the blow-by gas.

As described above, the flow rate Qgas of the blow-by gas flowing into the filter 63 varies in accordance with the engine load Qe of the internal combustion engine 1. More specifically, the flow rate Qgas of the blow-by gas increases as the engine load Qe of the internal combustion engine 1 increases, and decreases as the engine load Qe of the internal combustion engine 1 decreases. As shown in FIG. 14, however, a time lag occurs between variation in the engine load Qe of the internal combustion engine 1 and variation in the flow rate Qgas of the blow-by gas. The reason for this is that the blow-by gas that flows out of the crank case of the internal combustion engine 1 takes a certain amount of time to pass through the blow-by gas passage 5 and reach the oil removal apparatus 6.

Hence, in this modified example, when the engine load of the internal combustion engine 1 varies, the duty ratio of the voltage application period ton is modified at a predetermined time lag relative to the variation in the engine load. In so doing, the duty ratio of the voltage application period ton can be modified relative to actual variation in the flow rate of the blow-by gas flowing into the filter 63 as possible.

FIG. 15 is a flowchart showing a flow of voltage application control according to this modified example. This flow is stored in the ECU 10 and executed repeatedly by the ECU 10 at predetermined intervals while the internal combustion engine 1 is operative (or while the condition on which to execute removal of the oil particles contained in the blow-by gas is established). Note that in this flow, steps in which similar processing to the steps of the flowchart shown in FIG. 11 is performed have been allocated identical reference numerals, and description thereof has been omitted.

In this flow, processing of step S204 is executed after step S103. In step S204, a determination is made as to whether or not the engine load Qe of the internal combustion engine 1 has varied. Here, the engine load Qe of the internal combustion engine 1 may be determined to have varied when a difference between the engine load Qe of the internal combustion engine 1 read in step S101 and the engine load of the internal combustion engine 1 read in step S101 of the previously executed flow equals or exceeds a predetermined amount. When the determination of step S204 is negative, processing of step S104 is executed next. When the determination of step S204 is affirmative, on the other hand, processing of step S205 is executed next.

In step S205, a determination is made as to whether or not a predetermined delay time dtd has elapsed following the variation in the engine load Qe of the internal combustion engine 1. Note that the predetermined delay time dtd is determined in advance on the basis of a length of the blow-by gas passage 5 from the crank case of the internal combustion engine 1 to the oil removal apparatus 6, and stored in the ECU 10. When the determination of step S205 is negative, step S205 is executed again. When the determination of step S205 is affirmative, step S104 is executed next. In other words, the duty ratio of the voltage application period ton is modified to the value calculated in step S103.

Note that the length of the delay time from variation in the engine load of the internal combustion engine 1 to variation in the amount of blow-by gas flowing into the filter 63 may vary according to the engine load of the internal combustion engine 1 before and after the variation occurring at that time. The reason for this is that the flow speed of the blow-by gas flowing through the blow-by gas passage 5 varies in accordance with the engine load of the internal combustion engine 1. Hence, the predetermined delay time dtd serving as a reference in the determination of step S205 may be corrected on the basis of the engine load of the internal combustion engine 1 before and after the variation occurring at that time. In so doing, the duty ratio of the voltage application period ton can be aligned more precisely with the actual flow rate of the blow-by gas flowing into the filter 63.

Further, a time lag does not always have to be provided between variation in the engine load Qe of the internal combustion engine 1 and variation in the duty ratio of the voltage application period ton. For example, when the engine load of the internal combustion engine 1 increases such that the duty ratio of the voltage application period ton increases at a delay relative to an increase in the actual flow rate of the blow-by gas flowing into the filter 63, the oil particles may not be removed sufficiently from the blow-by gas in the oil removal apparatus 6. To prioritize reliable removal of the oil particles from the blow-by gas, therefore, when the engine load of the internal combustion engine 1 increases, the duty ratio of the voltage application period ton may be increased at the same time as the engine load varies, and when the engine load of the internal combustion engine 1 decreases, the duty ratio of the voltage application period ton may be reduced after the predetermined delay time elapses following the variation in the engine load.

(Third Embodiment)

An internal combustion engine and an intake/exhaust system thereof according to this embodiment are configured similarly to the first embodiment. An oil removal apparatus according to this embodiment is also configured similarly to the first embodiment. In this embodiment, instead of applying the voltage to the bipolar electrodes 61, 62 of the oil removal apparatus 6 intermittently, as in the first and second embodiments described above, the voltage is applied to the bipolar electrodes 61, 62 constantly while the internal combustion engine 1 is operative (or while the condition on which to execute removal of the oil particles contained in the blow-by gas is established).

Here, the dielectric polarization force and Coulomb force that act on the oil particles flowing through the filter 63 increase as the voltage applied to the bipolar electrodes 61, 62 increases. Therefore, when the flow rate of the blow-by gas flowing into the filter 63 decreases in a condition where a large enough voltage to ensure that a sufficient oil particle collection ratio can be secured over the entire filter 63 even after an increase in the flow rate of the blow-by gas is applied to the bipolar electrodes 61, 62, the oil particle collection ratio in the upstream portion of the filter 63 increases excessively, leading to an increase in the possibility of a blockage.

(Control of Applied Voltage)

Hence, in this embodiment, the voltage applied to the bipolar electrodes 61, 62 is modified in accordance with the flow rate of the blow-by gas flowing into the filter 63. FIG. 16 is a view showing a relationship between the flow rate Qgas of the blow-by gas and a voltage Va applied to the bipolar electrodes 61, 62 according to this embodiment. In this embodiment, as shown in FIG. 16, when the flow rate of the blow-by gas flowing into the filter 63 is low, the voltage applied to the bipolar electrodes 61, 62 is made smaller than when the flow rate of the blow-by gas is high.

FIG. 17 is a view illustrating a distribution of the amount of oil particles collected in the filter 63 according to this embodiment. FIG. 17(*a*) shows a distribution of the amount of collected oil particles when the flow rate of the blow-by gas flowing into the filter 63 decreases while the voltage applied to the bipolar electrodes 61, 62 remains constant, and FIG. 17(*b*) shows a distribution of the amount of collected oil particles when the voltage applied to the bipolar electrodes 61, 62 is reduced in response to a reduction in the flow rate of the blow-by gas flowing into the filter 63. Likewise in FIG. 17, black-outlined arrows denote the flow of the blow-by gas. Further, in FIG. 17, the shaded portions P denote the oil particles collected in the filter 63. Note that the shaded portions P are merely images representing the amount of oil particles collected in the positions of the shaded portions P, and do not indicate the manner in which the oil particles are actually collected.

As shown in FIG. 17(*a*), when the flow rate of the blow-by gas flowing into the filter 63 decreases while the voltage applied to the bipolar electrodes 61, 62 remains constant, the oil particles are more likely to be collected intensively in the upstream portion of the filter 63. In this embodiment, as described above, the voltage applied to the bipolar electrodes 61, 62 is reduced at this time. When the voltage applied to the bipolar electrodes 61, 62 is reduced, the dielectric polarization force and Coulomb force acting on the oil particles that flow into the filter 63 decrease. As a result, the oil particles passing through the upstream portion of the filter 63 are less likely to be collected in the filter 63. Hence, as shown in FIG. 17(*b*), a blockage caused by the oil particles in the upstream portion of the filter 63 can be suppressed even when the flow rate of the blow-by gas flowing into the filter 63 is small.

When the flow rate of the blow-by gas flowing into the filter 63 is low, on the other hand, the oil particles flowing into the filter 63 take a longer time to flow out of the filter 63 than when the flow rate is high. Therefore, even when the voltage applied to the bipolar electrodes 61, 62 decreases, leading to a reduction in the dielectric polarization force and Coulomb force acting on the oil particles, the proportion of the oil particles that are collected in the part of the filter 63 on the downstream side of the upstream portion after passing through the upstream portion of the filter 63 increases. As a result, a sufficient oil particle collection ratio is secured over the entire filter 63 even when the voltage applied to the bipolar electrodes 61, 62 is reduced in a case where the flow rate of the blow-by gas flowing into the filter 63 is low.

Furthermore, in this embodiment, the voltage applied to the bipolar electrodes 61, 62 is increased when the flow rate of the blow-by gas flowing into the filter is high. As a result, the dielectric polarization force and Coulomb force acting on the oil particles flowing through the filter 63 increase. It is therefore possible to secure a sufficient oil particle collection ratio over the entire filter 63 even when the flow rate of the blow-by gas increases such that the oil particles flowing into the filter 63 take less time to flow out of the filter 63.

(Flow of Voltage Application Control)

FIG. 18 is a flowchart showing a flow of voltage application control according to this embodiment. This flow is stored in the ECU 10 and executed repeatedly by the ECU 10 at predetermined intervals while the internal combustion engine 1 is operative.

In this flow, similarly to the flow shown in FIG. 11, first, the engine load Qe of the internal combustion engine 1 is read in step S101, whereupon the flow rate Qgas of the blow-by gas flowing into the filter 63 is calculated in step S102.

Next, in step S303, the voltage Va applied to the bipolar electrodes 61, 62 is calculated on the basis of the flow rate Qgas of the blow-by gas, calculated in step S102. In this embodiment, a relationship such as that shown in FIG. 16 between the flow rate Qgas of the blow-by gas and the voltage Va applied to the bipolar electrodes 61, 62 is stored in advance in the ECU 10 in the form of a map or a function. Then, in step S303, the voltage Va applied to the bipolar electrodes 61, 62 is calculated using the map or function.

Next, in step S304, the voltage applied to the bipolar electrodes 61, 62 is adjusted to the value calculated in step S303.

Note that likewise in this embodiment, similarly to the control of the duty ratio of the voltage application period according to the second embodiment, instead of estimating the flow rate Qgas of the blow-by gas flowing into the filter 63, the voltage Va applied to the bipolar electrodes 61, 62 may be controlled on the basis of at least one parameter that correlates with the flow rate Qgas of the blow-by gas, such as the engine load or cylinder inner pressure of the internal combustion engine 1, or the intake pipe pressure in the part of the intake passage 2 to which the blow-by gas passage 5 is connected.

Further, the voltage Va applied to the bipolar electrodes 61, 62 does not necessarily have to be varied continuously in response to variation in the flow rate Qgas of the blow-by gas, as shown in FIG. 16, and instead, the voltage Va applied to the bipolar electrodes 61, 62 may be varied in stages in response to variation in the flow rate Qgas of the blow-by gas.

Moreover, the control of the voltage applied to the bipolar electrodes according to this embodiment may be combined with the intermittent application of the voltage to the bipolar electrodes according to the first embodiment. Furthermore, the control of the voltage applied to the bipolar electrodes according to this embodiment may be combined with the control of the duty ratio of the voltage application period according to the second embodiment.

(Fourth Embodiment)

An internal combustion engine and an intake/exhaust system according to this embodiment are configured similarly to the first embodiment. An oil removal apparatus according to this embodiment is also configured similarly to the first embodiment. In this embodiment, while the internal combustion engine 1 is operative (or while the condition on which to execute removal of the oil particles contained in the blow-by gas is established), the voltage is applied constantly to the first bipolar electrode 61 of the oil removal apparatus 6, and a determination as to whether or not to apply the voltage to the second bipolar electrode 62 is made on the basis of the flow rate of the blow-by gas flowing into the filter 63.

When the voltage is applied to the bipolar electrode, the dielectric polarization force and Coulomb force that act on the oil particles flowing through the filter disposed between the anode and the cathode decrease as a distance between the anode and the cathode lengthens. In the oil removal apparatus 6 according to this embodiment, when the first bipolar electrode 61 is used alone as the bipolar electrode to which the voltage is applied, the distance between the anode and the cathode that are subjected to voltage application is longer than when the voltage is applied to both the first bipolar electrode 61 and the second bipolar electrode 62. Hence, in the oil removal apparatus 6 according to this embodiment, the dielectric polarization force and Coulomb force that act on the oil particles flowing through the filter 63 are smaller when the voltage is applied to the first bipolar electrode 61 alone than when the voltage is applied to both the first bipolar electrode 61 and the second bipolar electrode 62.

Here, the oil particles flowing into the filter 63 become more likely to be collected in the upstream portion of the filter 63 as the dielectric polarization force and Coulomb force that act on the oil particles flowing through the filter 63 increase. In this embodiment, therefore, when the flow rate of the blow-by gas flowing into the filter 63 is equal to or lower than a threshold, the voltage is applied to the first bipolar electrode 61 alone and voltage application to the second bipolar electrode 62 is stopped. When the flow rate of the blow-by gas flowing into the filter 63 exceeds the threshold, on the other hand, the voltage is applied to both the first bipolar electrode 61 and the second bipolar electrode 62.

FIG. 19 is a view illustrating a distribution of the amount of oil particles collected in the filter 63 according to this embodiment. FIG. 19(*a*) shows a distribution of the amount of collected oil particles when the flow rate of the blow-by gas flowing into the filter 63 is equal to or lower than the threshold such that the voltage is applied to both the first bipolar electrode 61 and the second bipolar electrode 62. FIG. 19(*b*) shows a distribution of the amount of collected oil particles when the flow rate of the blow-by gas flowing into the filter 63 is equal to or lower than the threshold such that the voltage is applied to the first bipolar electrode 61 alone. Likewise in FIG. 19, black-outlined arrows denote the flow of the blow-by gas. Further, in FIG. 19, the shaded portions P denote the oil particles collected in the filter 63. Note that the shaded portions P are merely images representing the amount of oil particles collected in the positions of the shaded portions P, and do not indicate the manner in which the oil particles are actually collected.

As shown in FIG. 19(*a*), when the flow rate of the blow-by gas flowing into the filter 63 is equal to or lower than the threshold such that the voltage is applied to both the first bipolar electrode 61 and the second bipolar electrode 62, the oil particles are likely to be collected intensively in the upstream portion of the filter 63. In this embodiment, as described above, voltage application to the second bipolar electrode 62 is stopped at this time such that the voltage is applied to the first bipolar electrode 61 alone. When the first bipolar electrode 61 is set as the only bipolar electrode to which the voltage is applied, the dielectric polarization force and Coulomb force that act on the oil particles flowing into the filter 63 decrease in comparison with a case where the voltage is applied to both the first bipolar electrode 61 and the second bipolar electrode 62. Accordingly, the oil particles passing through the upstream portion of the filter 63 are less likely to be collected in the filter 63. Hence, as shown in FIG. 19(*b*), a blockage caused by the oil particles in the upstream portion of the filter 63 can be suppressed even when the flow rate of the blow-by gas flowing into the filter 63 is equal to or lower than the threshold.

When the flow rate of the blow-by gas flowing into the filter 63 is low, on the other hand, the oil particles flowing into the filter 63 take a longer time to flow out of the filter 63 than when the flow rate is high. Therefore, even when the first bipolar electrode 61 is set as the only bipolar electrode to which the voltage is applied, leading to a reduction in the dielectric polarization force and Coulomb force acting on the oil particles, the proportion of the oil particles that are collected in the part of the filter 63 on the downstream side of the upstream portion after passing through the upstream portion of the filter 63 increases. As a result, a sufficient oil particle collection ratio is secured over the entire filter 63 even when the flow rate of the blow-by gas flowing into the filter 63 is equal to or lower than the threshold such that the first bipolar electrode 61 is set as the only bipolar electrode to which the voltage is applied.

Furthermore, in this embodiment, the voltage is applied to both the first bipolar electrode 61 and the second bipolar electrode 62 when the flow rate of the blow-by gas flowing into the filter is higher than the threshold, and as a result, the dielectric polarization force and Coulomb force acting on the oil particles flowing through the filter 63 increase. It is therefore possible to secure a sufficient oil particle collection ratio over the entire filter 63 even when the flow rate of the blow-by gas increases such that the oil particles flowing into the filter 63 take less time to flow out of the filter 63.

(Flow of Voltage Application Control)

FIG. 20 is a flowchart showing a flow of voltage application control according to this embodiment. This flow is stored in the ECU 10 and executed repeatedly by the ECU 10 at predetermined intervals while the internal combustion engine 1 is operative (or while the condition on which to execute removal of the oil particles contained in the blow-by gas is established).

In this flow, similarly to the flow shown in FIG. 11, first, the engine load Qe of the internal combustion engine 1 is read in step S101, whereupon the flow rate Qgas of the blow-by gas flowing into the filter 63 is calculated in step S102.

Next, in step S403, a determination is made as to whether or not the flow rate Qgas of the blow-by gas, calculated in step S102, is higher than a threshold Qgas0. Here, the threshold Qgas0 is set at a smaller value than a lower limit value of the flow rate of the blow-by gas at which a blockage is considered unlikely to be caused by the oil particles in the upstream portion of the filter 63 even when the voltage is applied to both the first bipolar electrode 61 and the second bipolar electrode 62. The threshold Qgas0 may be determined on the basis of experiments and the like, and is stored in advance in the ECU 10.

When the determination of step S403 is affirmative, next, in step S404, the voltage is applied to the first bipolar electrode 61 and the second bipolar electrode 62. When, on the other hand, the determination of step S403 is negative, next, in step S405, the voltage is applied to the first bipolar electrode 61 and voltage application to the second bipolar electrode 62 is stopped.

Note that likewise in this embodiment, similarly to the control of the duty ratio of the voltage application period according to the second embodiment, instead of estimating the flow rate Qgas of the blow-by gas flowing into the filter 63, the determination as to whether or not to apply the voltage to the second bipolar electrode 62 may be made on the basis of at least one parameter that correlates with the flow rate Qgas of the blow-by gas, such as the engine load or cylinder inner pressure of the internal combustion engine 1, or the intake pipe pressure in the part of the intake passage 2 to which the blow-by gas passage 5 is connected.

Further, the control of the bipolar electrode to which the voltage is applied according to this embodiment may be combined with the intermittent application of the voltage to the bipolar electrodes according to the first embodiment. Moreover, the control of the bipolar electrode to which the voltage is applied according to this embodiment may be combined with the control of the duty ratio of the voltage application period according to the second embodiment.

(Fifth Embodiment)

An internal combustion engine and an intake/exhaust system according to this embodiment are configured similarly to the first embodiment. However, an oil removal apparatus according to this embodiment differs from the oil removal apparatus according to the first embodiment in the configuration of the bipolar electrode. FIG. 21 is a schematic view showing a configuration of the oil removal apparatus according to this embodiment. FIG. 21 is a pattern diagram showing the oil removal apparatus 6 from above. Further, in FIG. 21, black-outlined arrows denote the flow of the blow-by gas.

A pair of bipolar electrodes 68 are provided in the case 64 of the oil removal apparatus 6 according to this embodiment. The bipolar electrode 68 includes an anode 68*a* and a cathode 68*b* that extend in the flow direction of the blow-by gas. A similar filter 63 to that of the first embodiment is provided between the anode 68*a* and the cathode 68*b* of the bipolar electrode 68. Note, however, that the anode 68*a* and the cathode 68*b* of the bipolar electrode 68 are not provided parallel to each other, and instead, a distance between the anode 68*a* and the cathode 68*b* is set to be shorter in a downstream portion than in an upstream portion in the flow direction of the blow-by gas (d1>d2).

FIG. 22 is a view illustrating a distribution of the amount of oil particles collected in the filter 63 according to this embodiment. FIG. 22(*a*) shows a distribution of the amount of collected oil particles when the anode and the cathode of the bipolar electrode are provided parallel to each other, and FIG. 22(*b*) shows a distribution of the amount of collected oil particles when the distance between the anode and the cathode of the bipolar electrode is set to be shorter in the downstream portion than in the upstream portion in the flow direction of the blow-by gas, as in the oil removal apparatus according to this embodiment. In FIGS. 22(*a*) and 22(*b*), an upper section shows the distribution of the amount of collected oil particles, and a lower section shows the magnitude of the Coulomb force and dielectric polarization force acting on the oil particles in respective positions of the filter in the flow direction of the blow-by gas. Likewise in FIG. 22, black-outlined arrows denote the flow of the blow-by gas. Further, in FIG. 22, the shaded portions P denote the oil particles collected in the filter 63. Note that the shaded portions P are merely images representing the amount of oil particles collected in the positions of the shaded portions P, and do not indicate the manner in which the oil particles are actually collected.

When the anode and the cathode of the bipolar electrode are provided parallel to each other, as shown in FIG. 22A, the Coulomb force and dielectric polarization force that act on the oil particles flowing through the filter are substantially identical in the upstream portion and the downstream portion of the filter. Therefore, as described above, the oil particles are likely to be collected intensively in the upstream portion of the filter. When, on the other hand, the distance between the anode and the cathode of the bipolar electrode is set to be shorter in the downstream portion than in the upstream portion in the flow direction of the blow-by gas, as in this embodiment, as shown in FIG. 22(*b*), the Coulomb force and dielectric polarization force that act on the oil particles flowing through the filter are smaller in the upstream portion of the filter than in the downstream portion in the flow direction of the blow-by gas. As a result, the oil particles are less likely to be collected in the upstream portion of the filter. Further, the dielectric polarization force and Coulomb force that act on the oil particles flowing through the filter are larger in the downstream portion of the filter than in the upstream portion of the filter. Therefore, the oil particles that have passed through the upstream portion of the filter are likely to be collected in the downstream portion of the filter.

Hence, with the configuration according to this embodiment, a blockage caused by the oil particles in the upstream portion of the filter 63 can be suppressed, and a sufficient oil particle collection ratio can be secured over the entire filter 63. Moreover, when the anode and the cathode of the bipolar electrode are provided parallel to each other, the amount of oil particles collected in the upstream portion of the filter and the amount of oil particles collected in the downstream portion of the filter cannot be made equal unless the voltage applied to the downstream part of the bipolar electrode in the flow direction of the blow-by gas is made larger than the voltage applied to the upstream part. With the configuration according to this embodiment, however, in which the distance between the anode 68*a* and the cathode 68*b* of the bipolar electrode 68 is set to be shorter in the downstream portion than in the upstream portion in the flow direction of the blow-by gas, the amount of oil particles collected in the upstream portion of the filter 63 and the amount of oil particles collected in the downstream portion of the filter 63 can be made substantially equal even when a uniform voltage is applied to the bipolar electrode 68. As a result, the oil particles can be collected effectively using the entire filter 63 from the upstream portion to the downstream portion.

Note that the voltage application control described in the first to third embodiments may be applied to the oil removal apparatus according to this embodiment.

(Reference Example)

FIG. 23 is a schematic view showing a configuration of an oil removal apparatus according to a reference example. FIG. 23 is a pattern diagram showing the oil removal apparatus 6 from above. Further, in FIG. 23, black-outlined arrows denote the flow of the blow-by gas. Note that the power supply that applies the voltage to the bipolar electrode and the ECU that controls application of the voltage have been omitted from FIG. 23.

The oil removal apparatus 6 according to this reference example includes a bipolar electrode 69 having an anode 69*a* and a cathode 69*b*, and a similar filter 63 to that of the first embodiment is provided between the anode 69*a* and the cathode 69*b* of the bipolar electrode 69. The anode 69*a* and the cathode 69*b* of the bipolar electrode 69 are respectively divided into four parts in the flow direction of the blow-by gas. In other words, the bipolar electrode 69 according to this reference example is configured such that four anodes and four cathodes are arranged in the flow direction of the blow-by gas.

In this reference example, voltages of different magnitudes are applied to the respective electrodes constituting the bipolar electrode 69. More specifically, a lower voltage is applied to the electrodes positioned further toward the upstream side in the flow direction of the blow-by gas. As a result, similarly to the configuration of the fifth embodiment, the dielectric polarization force and Coulomb force that act on the oil particles flowing through the filter 63 are smaller in the upstream portion of the filter 63 than in the downstream portion in the flow direction of the blow-by gas. Therefore, a blockage caused by the oil particles in the upstream portion of the filter 63 can be suppressed. Further, the dielectric polarization force and Coulomb force that act on the oil particles flowing through the filter 63 are larger in the downstream portion of the filter 63 than in the upstream portion of the filter 63. Therefore, a sufficient oil particle collection ratio can be secured over the entire filter 63.

Furthermore, in the configuration according to this reference example, voltages may be applied to the respective electrodes constituting the bipolar electrode 69 at different timings. According to this voltage application control, the oil particles are unlikely to be collected on the upstream side of the filter 63 in the flow direction of the blow-by gas at a timing where voltage application to the electrodes positioned on the upstream side is stopped. Therefore, concentrated collection of the oil particles in the upstream portion of the filter 63 can be suppressed. As a result, a blockage caused by the oil particles in the upstream portion of the filter 63 can be suppressed. Further, likewise according to this voltage application control, the oil particles can be collected using the entire filter 63 from the upstream side to the downstream side in the flow direction of the blow-by gas. As a result, a sufficient oil particle collection ratio can be secured over the entire filter 63.

REFERENCE SIGNS LIST

1: internal combustion engine
5: blow-by gas passage
6: oil removal apparatus
61, 62, 68, 69: bipolar electrode
61*a*, 62*a*, 68*a*, 69*a*: anode
61*b*, 62*b*, 68*b*, 69*b*: cathode
63, 67: filter
64: case
65: power supply
10: ECU

The invention claimed is:

1. An oil removal apparatus that removes oil particles contained in blow-by gas flowing through a blow-by gas passage of an internal combustion engine, the oil removal apparatus comprising:

a bipolar electrode having an anode and a cathode that extend in a flow direction of said blow-by gas;

a filter formed from a dielectric and disposed between said anode and said cathode of said bipolar electrode; and a controller comprising at least one processor configured to control application of a voltage to said bipolar electrode, wherein said controller controls application of said voltage to said bipolar electrode such that while said internal combustion engine is operative, a voltage application period in which said voltage is applied to said bipolar electrode and a voltage application stoppage period in which application of said voltage to said bipolar electrode is stopped are repeated alternately at predetermined periodic intervals, wherein one of the predetermined periodic intervals is a time period shorter than a time period in which the oil particles flow out of said filter after flowing into said filter.

2. The oil removal apparatus according to claim 1, wherein said controller makes a duty ratio of said voltage application period smaller when a flow rate of said blow-by gas flowing into said filter is low than when said flow rate of said blow-by gas is high.

3. The oil removal apparatus according to claim 2, wherein said controller modifies said duty ratio of said voltage application period in accordance with an engine load of said internal combustion engine, and when said engine load of said internal combustion engine varies, said controller modifies said duty ratio of said voltage application period after a predetermined delay time following said variation in said engine load.

4. An internal combustion engine comprising the oil removal apparatus according to claim 1.

5. An internal combustion engine comprising the oil removal apparatus according to claim 2.

6. An internal combustion engine comprising the oil removal apparatus according to claim 3.

* * * * *